US011254461B1

(12) United States Patent
Vega et al.

(10) Patent No.: US 11,254,461 B1
(45) **Date of Patent: *Feb. 22, 2022**

(54) HIGH SPEED LABEL APPLICATOR SYSTEMS AND METHODS

(71) Applicant: Label-Aire, Inc., Fullerton, CA (US)

(72) Inventors: Israel Vega, Brea, CA (US); George Allen, Irvine, CA (US)

(73) Assignee: Label-Aire, Inc., Fullerton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/988,264

(22) Filed: Aug. 7, 2020

Related U.S. Application Data

(63) Continuation-in-part of application No. 15/896,906, filed on Feb. 14, 2018, now Pat. No. 10,822,134.

(60) Provisional application No. 62/884,596, filed on Aug. 8, 2019, provisional application No. 62/458,994, filed on Feb. 14, 2017.

(51) Int. Cl.

| | |
|---|---|
| ***B65C 9/18*** | (2006.01) |
| ***B65C 9/00*** | (2006.01) |
| ***B65C 9/22*** | (2006.01) |
| ***B65C 9/04*** | (2006.01) |

(52) U.S. Cl.
CPC ..... *B65C 9/1819* (2013.01); *B65C 9/0065* (2013.01); *B65C 9/04* (2013.01); *B65C 9/2204* (2013.01); *B65C 2009/1846* (2013.01)

(58) Field of Classification Search
CPC ... B65C 9/1819; B65C 9/0065; B65C 9/2204; B65C 9/04; B65C 2009/1846
See application file for complete search history.

(56) References Cited

U.S. PATENT DOCUMENTS

| | | | |
|---|---|---|---|
| 3,834,963 | A | 9/1974 | Hoffman |
| 4,188,843 | A | 2/1980 | Dickey |
| 4,210,484 | A | 7/1980 | Crankshaw et al. |
| RE30,419 | E | 10/1980 | Crankshaw et al. |
| 4,255,220 | A | 3/1981 | Kucheck et al. |
| 4,323,416 | A | 4/1982 | Malthous |
| 4,526,645 | A | 7/1985 | Malthouse et al. |
| 4,544,431 | A | 10/1985 | King |
| 4,680,082 | A | 7/1987 | Kearney |
| 4,758,300 | A | 7/1988 | King |
| 4,844,771 | A | 7/1989 | Crankshaw et al. |
| 4,931,122 | A | 6/1990 | Mitchell |
| 5,039,374 | A | 8/1991 | Winter |
| 5,082,520 | A | 1/1992 | West et al. |

(Continued)

FOREIGN PATENT DOCUMENTS

| | | | |
|---|---|---|---|
| WO | 2005035263 | A1 | 4/2005 |
| WO | 2006016823 | A1 | 2/2006 |
| WO | 2009120096 | A1 | 10/2009 |

*Primary Examiner* — Cynthia L Schaller
(74) *Attorney, Agent, or Firm* — Stout, Uxa & Buyan, LLP; Donald E. Stout

(57) ABSTRACT

A label application system for applying paper non-pressure adhesive labels to relatively short, round, straight-walled articles is constructed and designed so that labels to be applied to passing articles are delivered to the label application zone on a vacuum conveyor in a short feed orientation, with each label being oriented lengthwise across a width of the vacuum conveyor. At the time of labeling, the label is held stationary on a flat vacuum surface, and the label is applied by spinning the articles past the vacuum surface. As a result, the system is capable of labeling articles at processing speeds of up to or exceeding 800 articles per minute.

18 Claims, 18 Drawing Sheets

(56) References Cited

U.S. PATENT DOCUMENTS

| | | | |
|---|---|---|---|
| 5,421,948 | A | 6/1995 | Crankshaw et al. |
| 5,512,120 | A | 4/1996 | Hinton et al. |
| 5,643,395 | A | 7/1997 | Hinton |
| 5,645,669 | A | 7/1997 | Crankshaw et al. |
| 5,935,361 | A | 8/1999 | Takahashi et al. |
| 5,964,975 | A | 10/1999 | Hinton |
| 6,095,218 | A | 8/2000 | Delmolino |
| 2002/0029856 | A1 | 3/2002 | Gonzalo |
| 2003/0121593 | A1 | 7/2003 | Monroe |
| 2005/0161164 | A1 | 7/2005 | Sleiman et al. |
| 2013/0199716 | A1 | 8/2013 | Vega et al. |
| 2013/0251944 | A1 | 9/2013 | Kian |
| 2015/0151868 | A1 | 6/2015 | Vega |

HIGH SPEED LABEL APPLICATOR SYSTEMS AND METHODS

This application claims priority under 35 U.S.C. 119 to U.S. Provisional Application Ser. No. 62/884,596, entitled High Speed Label Applicator Systems and Methods, filed on Aug. 8, 2019, and is also a continuation-in-part (CIP) under 35 U.S.C. 120 of U.S. patent application Ser. No. 15/896,906, entitled High Speed Label Applicator Systems and Methods, filed on Feb. 14, 2018, which in turn claims priority under 35 U.S.C. 119 to U.S. Provisional Application Ser. No. 62/458,994, entitled High Speed Label Applicator Systems and Methods, filed on Feb. 14, 2017. This application is also related to U.S. application Ser. No. 13/956,233, entitled High Speed Label Applicator and Methods, filed on Jul. 31, 2013, and now issued as U.S. Pat. No. 10,040,591, and to U.S. Provisional Application No. 61/678,369, entitled High Speed Label Applicator and Methods, filed on Aug. 1, 2012. Each of the foregoing applications and patents are expressly incorporated herein by reference, in their entirety.

FIELD OF THE INVENTION

This invention relates generally to label applicator systems and more particularly, to label applicator systems and methods using vacuum surface systems for gluing paper labels and applying those paper labels to generally cylindrical objects being conveyed past the label application zone.

BACKGROUND OF THE INVENTION

Label applicators for applying pressure-sensitive adhesive-backed labels to articles passing the applicator on a conveyor are well known. Label applicators of this general type are shown in commonly assigned U.S. Pat. No. 4,255,220, issued to Kucheck et al., U.S. Pat. No. 4,844,771, issued to Crankshaw et al., and U.S. Pat. No. 5,421,948, issued to Crankshaw et al, for example. Other prior art references of interest include Published U.S. Patent Application No. 2003/0121593, U.S. Pat. No. 5,935,361 to Takahashi et al., U.S. Pat. No. 5,643,395 to Hinton, U.S. Pat. No. 5,039,374 to Winter, Published U.S. Patent Application No. US 2003/0121593, International Publication No. WO 2005/035263, International Publication No. 2006/016823, and International Publication No. 2009/120096. All of the aforementioned patents and published patent applications are herein expressly incorporated by reference, in their entirety. Typically, such labeling apparatus comprise a supply of adhesive-backed labels carried upon an elongate web of release material which is fed from a supply reel to a take-up reel, with the label applicator disposed between the two reels.

One particular category of articles to be labeled are round articles, such as snuff cans, tuna cans, and the like, where the label to be applied is long and narrow relative to its length and the article has a wall which is substantially straight. Typically, because of limitations in currently available labeling equipment, such labels are disposed in a "long feed" configuration on the web to be fed into the label applicator. "Long feed" label configurations are inefficient, in that the label feed mechanism must advance a greater distance (at least the length of each label) to deliver each label and fewer labels can be carried on each roll, thereby requiring change out of the label roll more often. Since the label application system must be shut down to perform the label roll change out, this reduces labeling volume. Current long feed systems can only handle about 300 articles per minute.

Accordingly, it would be advantageous to have a labeling system which would be capable of labeling such round articles using a "short feed" label configuration, as such an arrangement would be much more efficient and permit much faster labeling processing speeds.

The invention, together with additional features and advantages thereof, may best be understood by reference to the following description taken in conjunction with the accompanying illustrative drawings.

SUMMARY OF THE INVENTION

In one aspect of the invention, there is provided a label application system which applies labels to articles. This system includes a label applicator assembly comprising a conveyor assembly which includes a vacuum conveyor on which a flat vacuum surface is disposed. An unwind assembly is provided which comprises a shaft which is rotatably driven to rotate the shaft, the shaft being adapted to hold a roll having a carrier web thereon and the carrier web feeding onto the vacuum conveyor. A label cutter is disposed at a selected location on the vacuum conveyor for cutting the carrier web into discrete labels of a desired size. A glue applicator is disposed at a second selected location on the vacuum conveyor, downstream of the label cutter, for applying glue to labels passing by the glue applicator after being cut by the label cutter. An article conveyor assembly is provided which transports articles to be labeled past the label applicator assembly, the article conveyor assembly comprising a label application zone adjacent to the label applicator assembly. Advantageously, a stepper motor is provided for moving the conveyor so that the flat vacuum surface moves downstream past the label cutter and the glue applicator and through the label application zone, the stepper motor being controlled to stop the vacuum conveyor so that the vacuum surface is stationary during the application of a label to an article passing through the label application zone on the article conveyor assembly, and the stepper motor being further controlled to restart the vacuum conveyor to move a next label into the label application zone as a next article to be labeled approaches the label application zone on the article conveyor.

In an exemplary embodiment of the invention, the label cutter comprises a laser cutter. The carrier web comprises a lower side and an upper side. In some embodiments, the carrier web is pre-printed on its lower side with information to appear on the labels to be applied to the articles passing through the label application zone on the article conveyor. In other embodiments, the labels cut by the label cutter are printed on their respective lower sides with desired information by a printing station disposed on the vacuum conveyor. The glue applied by the glue applicator is applied to the upper side of labels passing thereby, and may comprise a hot melt adhesive.

The vacuum surface comprises a plurality of vacuum apertures for drawing of vacuum pressure therethrough, to hold the carrier web and cut labels on the vacuum surface. The articles passing through the label application zone on the article conveyor are driven to rotate by the article conveyor assembly, so that rotation of the articles assists in applying the label to a surface of the articles.

Advantageously, the vacuum conveyor and the article conveyor are oriented so that the vacuum conveyor feeds labels into the label application zone in a direction transverse to a direction along which articles are conveyed through the label application zone by the article conveyor. Additionally, each label, after being cut, has a longer dimension and a shorter dimension, and lies on the vacuum conveyor with its longer dimension lying along a width of the vacuum conveyor. These particular arrangements are important to achieving the remarkably high labeling speeds of the present system.

In another aspect of the invention, there is provided a label application system which applies labels to articles. This system includes a label applicator assembly comprising a conveyor assembly which includes a vacuum conveyor on which a flat vacuum surface is disposed. An unwind assembly is provided which comprises a shaft which is rotatably driven to rotate the shaft, the shaft being adapted to hold a roll having a carrier web thereon and the carrier web feeding onto the vacuum conveyor. A label cutter is disposed at a selected location on the vacuum conveyor for cutting the carrier web into discrete labels of a desired size. A glue applicator is disposed at a second selected location on the vacuum conveyor, downstream of the label cutter, for applying glue to labels passing by the glue applicator after being cut by the label cutter. An article conveyor assembly is provided which transports articles to be labeled past the label applicator assembly, the article conveyor assembly comprising a label application zone adjacent to the label applicator assembly.

Advantageously, the vacuum conveyor and the article conveyor are oriented so that the vacuum conveyor feeds labels into the label application zone in a direction transverse to a direction along which articles are conveyed through the label application zone by the article conveyor. Additionally, each label, after being cut, has a longer dimension and a shorter dimension, and lies on the vacuum conveyor with its longer dimension lying along a width of the vacuum conveyor.

In an exemplary embodiment of the invention, the label cutter comprises a laser cutter. The carrier web comprises a lower side and an upper side. In some embodiments, the carrier web is pre-printed on its lower side with information to appear on the labels to be applied to the articles passing through the label application zone on the article conveyor. In other embodiments, the labels cut by the label cutter are printed on their respective lower sides with desired information by a printing station disposed on the vacuum conveyor. The glue applied by the glue applicator is applied to the upper side of labels passing thereby, and may comprise a hot melt adhesive.

The vacuum surface comprises a plurality of vacuum apertures for drawing of vacuum pressure therethrough, to hold the carrier web and cut labels on the vacuum surface. The articles passing through the label application zone on the article conveyor are driven to rotate by the article conveyor assembly, so that rotation of the articles assists in applying the label to a surface of the articles.

In still another aspect of the invention, there is provided a method for applying labels to articles, which comprises steps of feeding a carrier web comprising a length of paper onto a vacuum conveyor comprising a flat surface having vacuum apertures disposed therein, drawing a vacuum pressure through the vacuum apertures to hold a lower side of the carrier web on the vacuum conveyor surface, moving the vacuum conveyor so that the carrier web passes a label cutter, using the label cutter to cut the carrier web into labels of a desired size, having a length and a width, moving the vacuum conveyor so that the cut labels pass a glue applicator, using the glue applicator to apply glue to an upper side of each cut label passing the glue applicator, moving an article conveyor so that articles disposed on the article conveyor pass through a label application zone, feeding the cut labels into the label application zone on the vacuum conveyor so that the length of each label lies along a width of the vacuum conveyor, and stopping the vacuum conveyor so that a label thereon is held in a stationary position as it is applied to a passing article on the article conveyor. A further step comprises re-starting the vacuum conveyor after the label has been applied to the passing article and thereby moving a next label on the vacuum conveyor into the label application zone for application to a next passing article on the article conveyor.

DETAILED DESCRIPTION OF THE INVENTION

Figure 1:
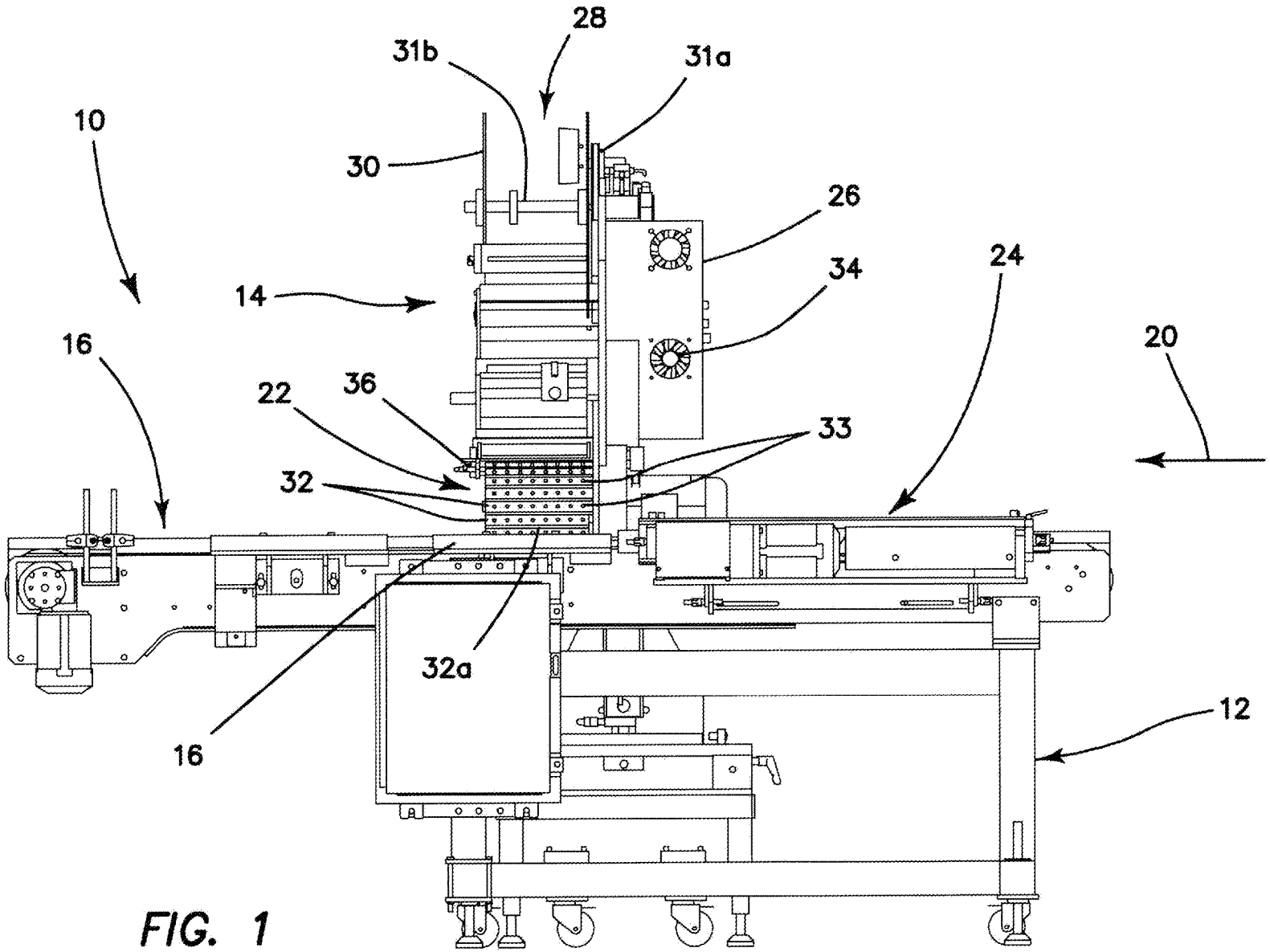
FIG. 1 is an elevational view of one exemplary embodiment of a labeling system constructed in accordance with the principles of the present invention.
Figure 2:
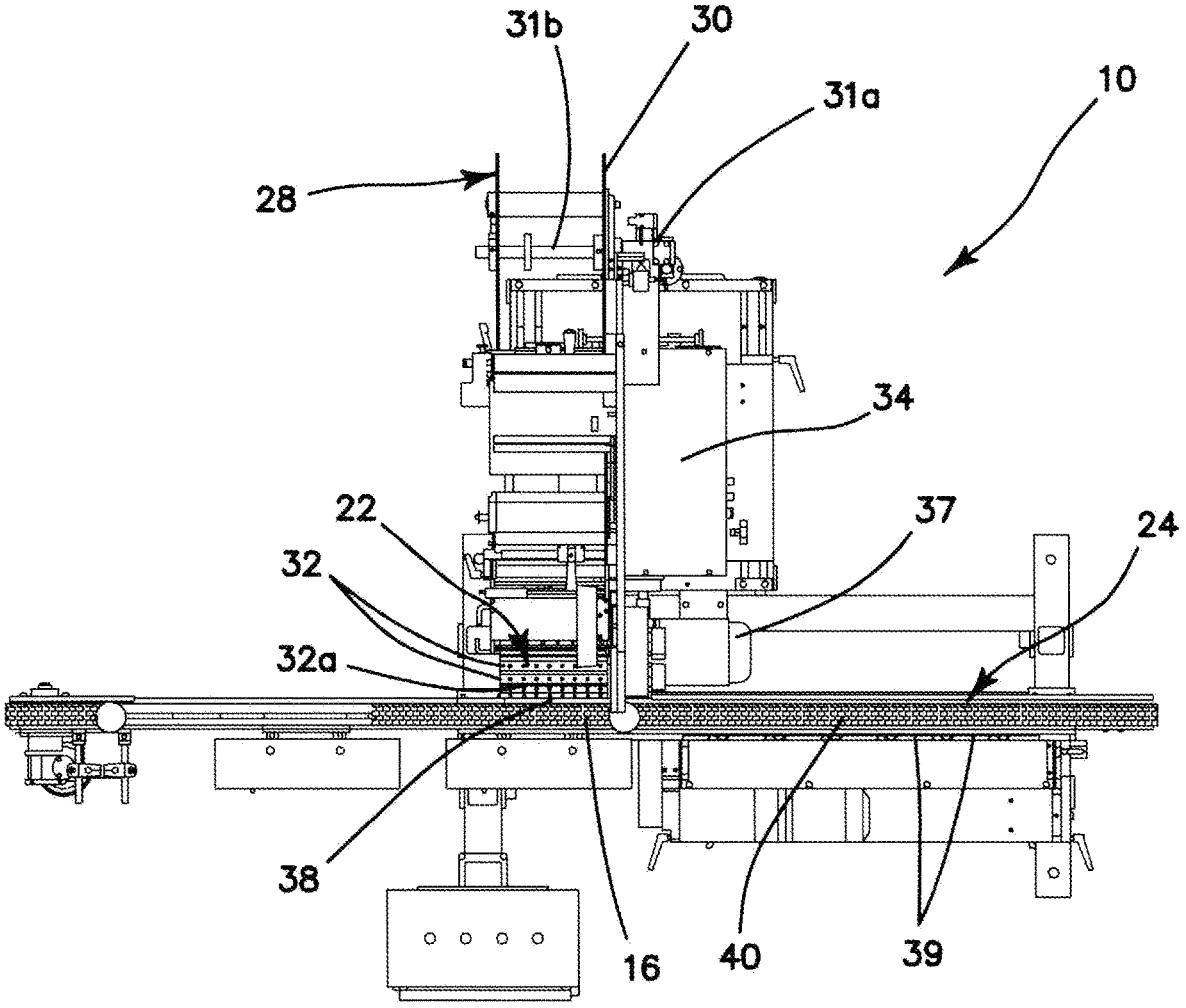
FIG. 2 is a top view of the labeling system of FIG. 1.

Referring now more particularly to the drawings, wherein like reference numerals designate identical or corresponding parts throughout the several views and embodiments, there is shown in FIGS. 1 and 2 one embodiment of a label application system 10 constructed in accordance with the principles of the present invention. The system 10 comprises a main frame 12, a label applicator assembly 14, and a conveyor assembly 16, for transporting articles to be labeled past the label applicator assembly. Arrow 20 illustrates the direction of product flow on the conveyor assembly 16.

Other elements of the system 10 to be described below include a vacuum drum assembly 22, a feedscrew assembly 24, and a control panel 26.

The inventive system 10 is particularly adapted to label short, round and straight-walled articles 27 (FIG. 4), such as snuff cans, tuna cans, and the like, where the label to be applied is long and narrow relative to its length and the article has a wall which is substantially straight. The labels at issue typically have a length which exceeds their width by a length to width ratio of about 5:1 or more, in some cases 8:1 or more. Typically, because of limitations in currently available labeling equipment, such labels are disposed in a "long feed" configuration on the web to be fed into the label applicator. "Long feed" label configurations (the term "Long feed" means that the label feed direction is parallel to the direction of travel of the articles being labeled, i.e. parallel to the floor) are inefficient, in that the label feed mechanism must advance a greater distance (at least the length of each label) to deliver each label and fewer labels can be carried on each roll, thereby requiring change out of the label roll more often. Since the label application system must be shut down to perform the label roll change out, this reduces labeling volume. Current long feed systems can only handle about 300 articles per minute.

The current inventive labeling system is able to apply the labels in a "short feed" orientation, meaning that the labels are fed in a direction generally orthogonal to the direction of travel of the articles being labeled. Because this feeding direction also allows the labels to be disposed on the carrier web with their length lying along the width of the carrier web, this allows substantially more labels to be carried on each label roll, reducing change-out shutdowns of the system. Additionally, the web need only advance by a distance equal to the width of the label, plus any space between adjacent labels, to deliver the next label to the application zone. As a result, the present system is capable of labeling as many as 800 articles per minute or more, an efficiency increase of at least about 100% over prior art systems.

Now, with more particular reference to FIGS. 1-4, the system 10 will be described in greater detail. The label applicator 14 comprises an unwind assembly 28 having an unwind disk 30 on which is carried a roll of labels for application to the passing articles 27 (FIG. 4) on the conveyor 16, which moves in a direction indicated by the arrow 20. The unwind assembly 28 is comprised of the aforementioned assembly unwind disk 30, as well as an assembly unwind drive mechanism 31*a* with brake, and a shaft or spindle 31*b* for accommodating the roll of labels. The unwind assembly 28 is rotatably driven through the assembly unwind drive mechanism 31*a*.

Figure 3:
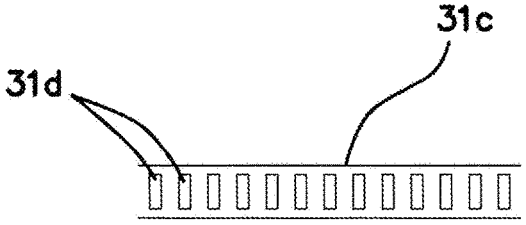
FIG. 3 is a schematic view showing a length of carrier web with labels of the type to be applied using the inventive system disposed thereon.

As noted above, the roll of labels comprises a carrier web, with a series of pressure-sensitive labels disposed on the web, adhesive side down. The labels are typically preprinted with appropriate brand and content information. The labels are arranged in a short feed orientation, wherein the length of each label is oriented to extend across the width of the carrier web, with a desired spacing between successive labels. A portion of a length of carrier web 31*c*, having a plurality of labels 31*d* disposed thereon, is shown in FIG. 3. When the roll of labels 31*d* on the carrier web 31*c* is mounted on the unwind disk 30, the labels 31*d* are disposed so that they feed onto the vacuum drum assembly 22 with their leading edge comprising the length of each label, in the short feed direction.

Figure 4:
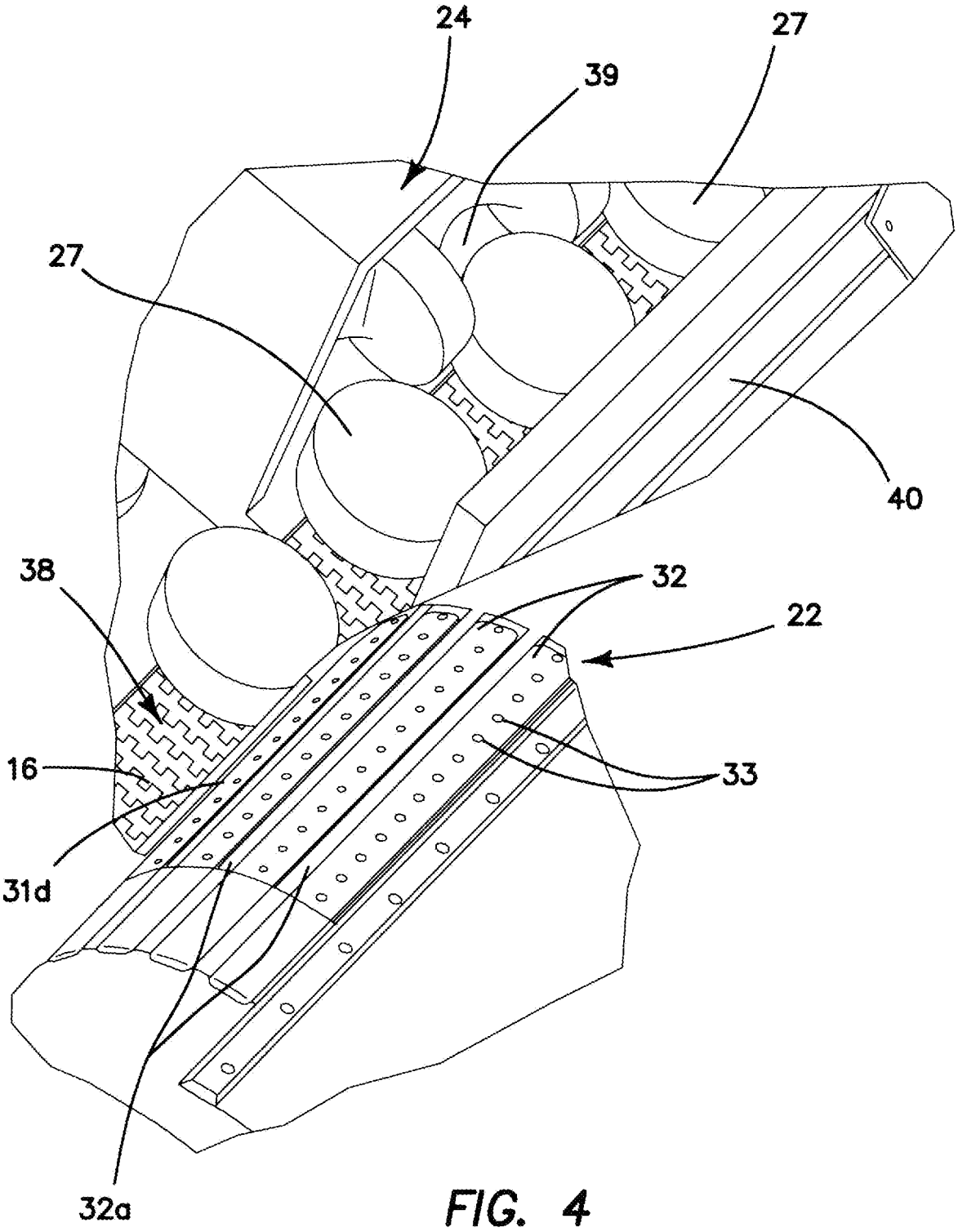
FIG. 4 is an illustration of one approach for dispensing articles to be labeled from the feed screw of the inventive system into the label application zone.

As noted above, the carrier web 31*c*, unwinding from the unwind assembly 28, is routed about idler rollers along a feedpath to the vacuum drum 22 (FIGS. 1, 2, 4). The vacuum drum is constructed to comprise a plurality of label flats 32. Each label flat comprises a substantially flat surface interspersed with vacuum apertures 33, wherein the surface of each label flat is sized to accommodate a label separated from the carrier web. In the illustrated example, there are twenty label flats 32 which together comprise the outer circumferential surface of the vacuum drum 22. Angled transitional edges 32*a* are disposed between each label flat 32, formed by the respective joined edges of each label flat. The vacuum drum 22 is constructed to be modular, so that label flats 32 are interchangeable. Because of this modular construction, the number and size of the label flats 32 on each drum can be changed out depending upon the size of the label to be applied. As is typical with prior art non-modular vacuum drums, the interior of the vacuum drum 22 is hollow, and connected to vacuum fans or pumps 34 for drawing a vacuum through the vacuum apertures 33 in the surface of each label flat 32, and through the hollow interior of the drum 22, to hold the non-adhesive side of a label on each label flat 32. It is noted that having a flat vacuum surface for receiving each label is important to the efficient functionality of the system, and its unique and previously unknown ability to apply labels to short, round, straight-walled articles at speeds substantially in excess of 300 articles per minute.

As is known in the art, the label feedpath from the label roll is directed to a label peeler 36 for separating the label from the carrier web and delivering it to the next available label flat 32, with the non-adhesive side down. Thus, the non-adhesive side of the label is held by the vacuum pressure against the surface of the label flat 32, with the adhesive side facing outwardly. This process continues as the vacuum drum is rotated in stepwise fashion, using a stepper motor 37 or the like, advancing rotationally the distance of the width of a single label flat 32 with each step, to simultaneously present one label flat 32 to the peeler 36 for delivery of a label onto the surface of that label flat, and to a label application zone 38 for delivery of another label, disposed on the surface of another label flat 32, to an article passing through the label application zone 38.

Within the control panel 26 are disposed the electrical controls necessary to operate the system. These controls are, generally speaking, typical in the industry and will not be further described herein.

In operation, an operator activates the label application system by actuation of an appropriate control switch on an operator control panel 26. Once operational, the roll of labels is unwound from the unwind assembly 28, so that the carrier web travels along the feedpath of the device, about idler rollers. As a result, a leading edge of the carrier web reaches the label peeler 36, and a first label is separated from the web and disposed onto a label flat on the vacuum drum 22. As noted above, the label is retained on the surface of a label flat 32 because of vacuum pressure applied through the vacuum apertures 33 on that surface, by the fans 34, with its adhesive side out. The vacuum drum is stepped rotationally, by the motor 37, as the carrier web is advanced by the width of a label, plus the spacing between adjacent labels on the web, until the next label is applied, by the peeler 36, to the next label flat 32. This process continues as the vacuum drum continues to be stepped rotationally in the same manner, so that each label flat 32 receives a label. In the meantime, the conveyor assembly 14 is activated so that articles to be labeled travel toward the label application zone 38, in the direction of the arrow 20.

The feedscrew assembly or product separation station 24 is constructed to rotate adjacent to the conveyor belt, for timing purposes, in a manner well known in the labeling art, so that passing articles are received into grooves 39 between the screws of the feedscrew, thus spacing them appropriately as they sequentially enter the label application zone. The feedscrew assembly 24 comprises a back pressure control station, controlling the article pressure generated by the mass quantity of articles at the in-feed, and also creates article separation. As an article to be labeled travels toward the label application zone 38 and approaches the vacuum drum 22, it is placed into a spinning rotation by its contact with and travel along an adjacent vertically-oriented flat belt assembly, in a position opposed to the labeling surface of the vacuum drum 22, which comprises a part of the conveyor system 16. Such a system is not dissimilar to the system shown and disclosed in U.S. Pat. No. 4,931,122 to Mitchell, herein expressly incorporated by reference, in its entirety. However, advantageously, in the inventive system, the article 27 is dispensed out of the feedscrew and is set into rotation as it contacts the outwardly facing adhesive side of the next label to be applied, on a label flat 32 which has been rotated into the label application zone 38. This contact causes the end of the label to adhere to the side wall of the article. As the spinning article continues to move along the conveyor, its spinning action against the adhesive side of the label causes that label to be wrapped about the article, thus completing the labeling process. This approach is in contrast of that known in the prior art, represented by Mitchell, wherein the feedscrew 15 extended downstream, adjacent and opposed to the vacuum drum 11, so that the article being labeled in the Mitchell patent was still disposed in the grooves of the feedscrew as it was being labeled. This prior art approach is not suitable from the short, round articles 27 for which the inventive system is intended. The inventor has discovered that it is not necessary to employ a prior art starwheel to continue the rotation of articles to be labeled within the label application zone, as previously thought. They can be maintained in an adequately spinning state through the label application zone simply by use of the aforementioned flat belt assembly, thus resulting in an advantageously simpler and faster labeling system, as well as one which is efficient since it allows for a label short feed orientation, as discussed above.

Figure 7:
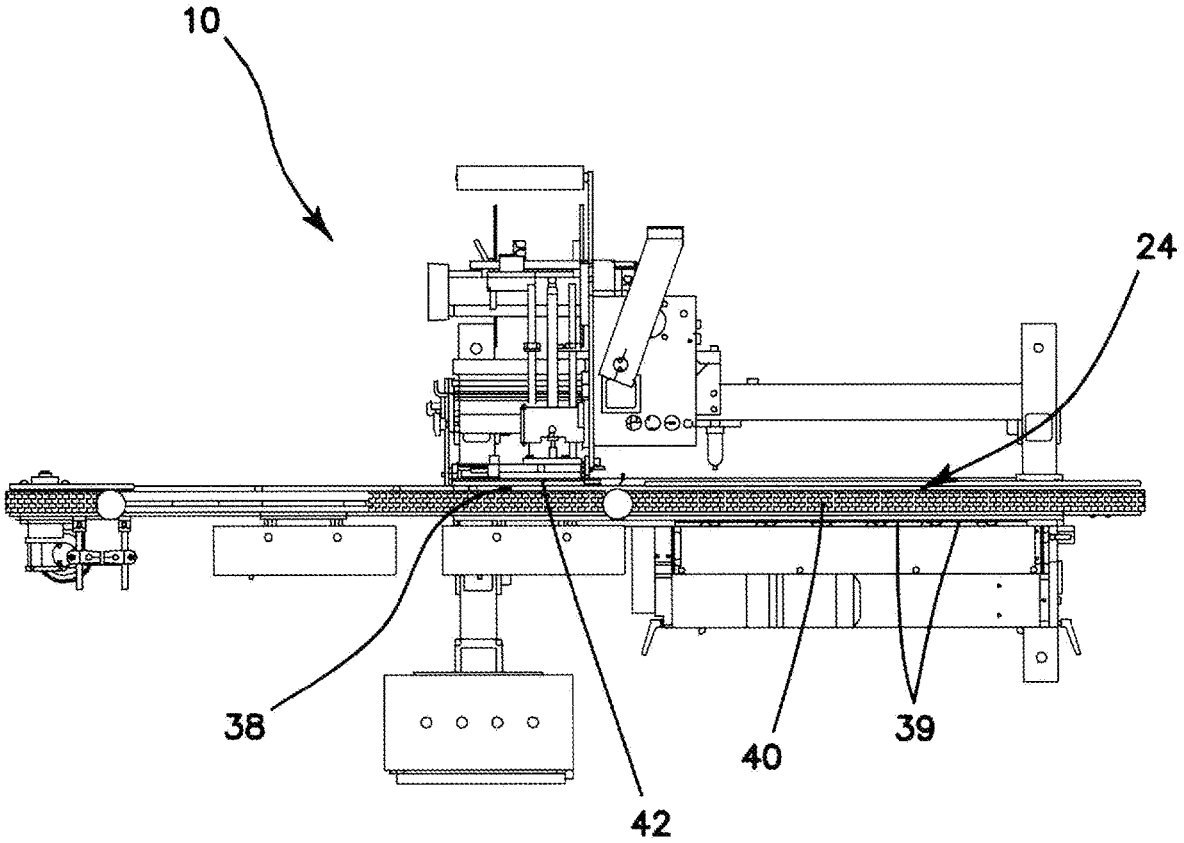
FIG. 7 is a top view of the embodiment of FIGS. 5 and 6.

FIGS. 2, 4, and 7 illustrate an alternative apparatus 40, namely a vertically oriented moving belt assembly, which may be utilized instead of the feedscrew assembly 24 for operation as the pressure control station.

In the inventive system, the labeled article 27, after passing through the label application zone 38, then continues along the conveyor for further handling, such as packing and shipping, and the next article 27 to be labeled goes through the same process, with respect to the next label to be rotated into the label application zone. It is noted that FIG. 4 illustrates one orientation of the vacuum drum assembly relative to the passing articles 27, whereas FIGS. 1 and 2 illustrate the vacuum drum assembly on an opposing side of the conveyor assembly 16. This is merely for the purpose of clarifying that the orientation of the system is a matter of design application—which side of the conveyor assembly the vacuum drum and label applicator assembly are disposed is dependent upon industrial design factors outside of the scope of the present invention. A key aspect of the invention is that the label is presented to the article in the label application zone in a stationary state, with the vacuum surface 32 held stationary. As the article to be labeled passes by the label application zone, the article is rotated by the belt system to cause the stationary label to be wrapped about the circumference of the article, thereby completing the labeling process.

Figure 5:
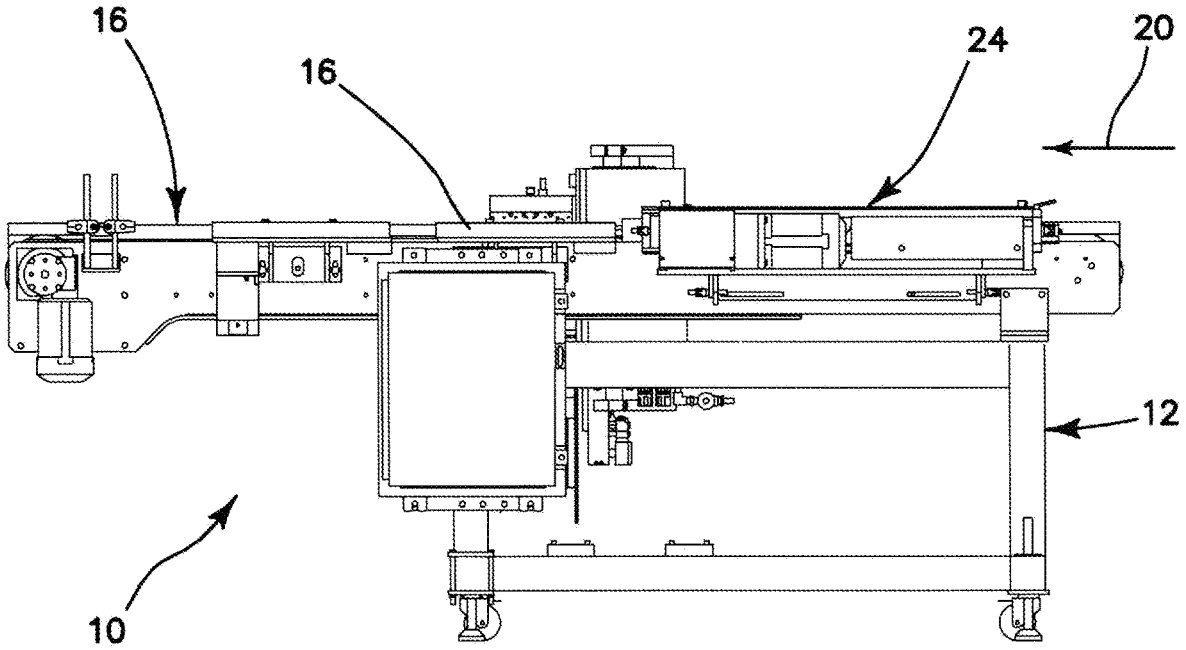
FIG. 5 is an elevational view of a modified exemplary embodiment of the labeling system of FIGS. 1 and 2.
Figure 6:
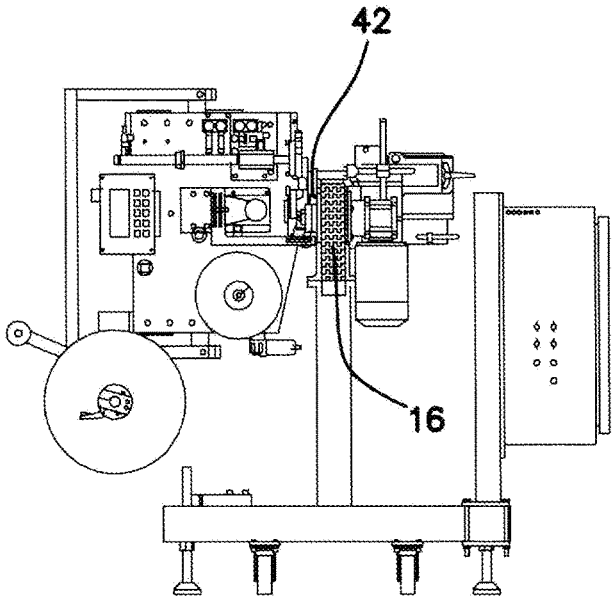
FIG. 6 is an end view of the embodiment of FIG. 5.

FIGS. 5-7 illustrate a modified embodiment of the present invention, which is similar in operational principle to the vacuum drum embodiment of FIGS. 1-2, but instead utilizes vacuum applicator 42 to deliver the label to the spinning article, rather than a vacuum drum. The vacuum applicator may comprises a tamp applicator, as well known in the art, for example, as shown and disclosed in commonly assigned U.S. Pat. No. 4,844,771, herein expressly incorporated by reference in its entirety, or it may simply be a stationary platform supporting the vacuum surface. Whether the vacuum applicator is initially moved toward the article to be labeled, as is the case with a tamp applicator, or is already adjacent to the passing articles, and thus is always in a fixed position, the important thing is that the vacuum surface of the label applicator is stationary during the labeling process. Thus, the actually labeling step is substantially identical to that occurring using the vacuum drum discussed above.

In this embodiment, wherein like elements are identified by like reference numerals, as in the vacuum drum embodiment, the article 27 is initiated into a spinning rotation as it travels into the label application zone, then engages a label disposed on the label applicator 42, which is disposed so that the upstream end of the label thereon will contact the outer sidewall of the article to be labeled. Again, as the article travels downstream along the conveyor and the moving belt 40, the label will be wrapped about the circumference thereof to complete the labeling process quickly and efficiently, with minimal error rates. The label applicator 42 comprises a pad having vacuum apertures therein, a vacuum pad, for receiving a dispensed label thereon, adhesive side up. The pad receives a label 31*d* thereon, as the label is dispensed from the carrier web 31*c* (FIG. 3), and is disposed in stationary fashion adjacent to a rotating passing article 27 to be labeled. Significantly, in this alternate embodiment, the articles 27 are rotated using a feedscrew mechanism 24 or vertically-oriented moving belt 40, as in the embodiment of FIGS. 1-4, and then dispensed from the pressure control station, upstream of the label application zone 38, into that zone to receive a label.

What is particularly advantageous about this inventive approach is that the label is stationary in the label application zone, while it is being applied to the spinning article, unlike prior art systems for labeling cylindrical articles using long, thin labels, which utilize a nip method and are fed in the direction of flow of the articles, rather than orthogonal to that direction of flow, as is the case with the present invention.

While the foregoing invention embodiments have been particularly suited to the application of pressure-sensitive labels, the principles of the present invention apply, as well, to other labels often used for labeling articles. These alternative labels are typically comprised of paper, which has been pre-printed on one side with the desired information to be labeled on an article, which labels are glued on their back side, during the labeling process. Such a modified embodiment is shown in FIGS. 8-11, which will now be described.

Figure 8:
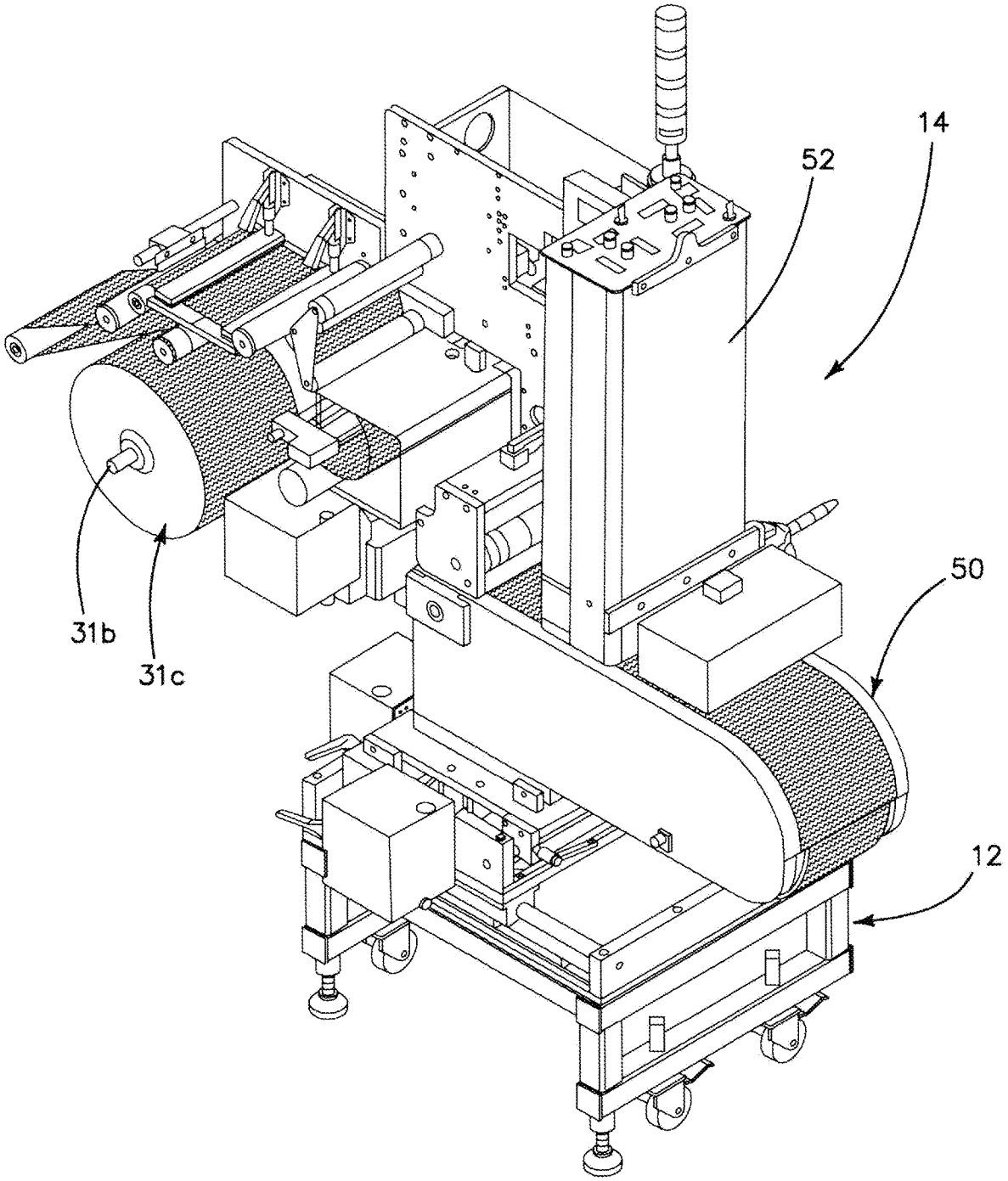
FIG. 8 is an isometric view of a modified exemplary embodiment of the labeling applicator of the present invention which is adapted for use with paper/glue labels.
Figure 9:
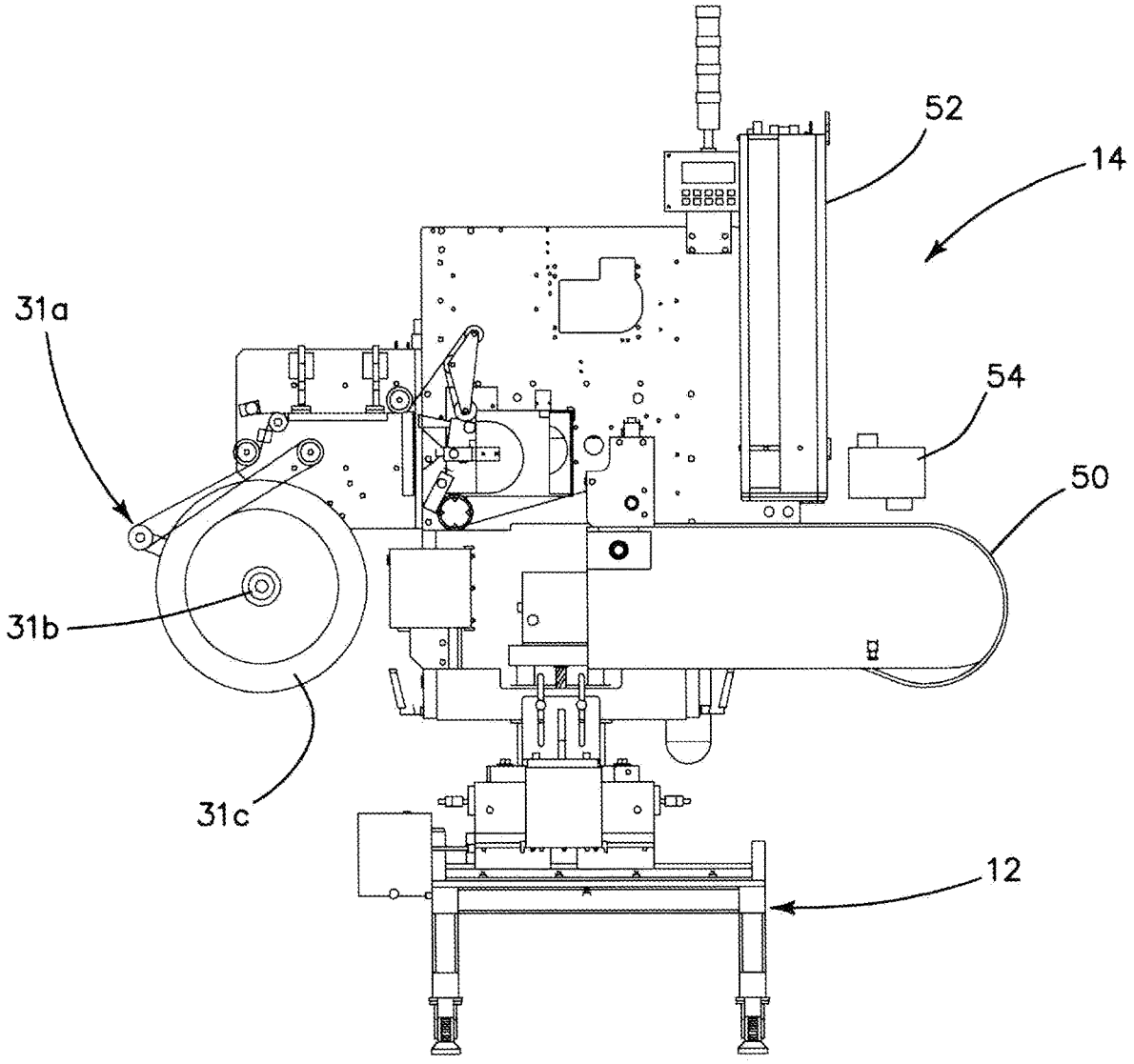
FIG. 9 is a front view of the labeling applicator of FIG. 8.

With reference now to FIGS. 8 and 9, a label applicator assembly 14 for use with paper labels and incorporating the features of the present invention is illustrated. In this embodiment, like elements to those in the previously described embodiments are identified with like reference numerals. Thus, in this embodiment, the label applicator assembly 14 is supported on a main frame 12. A roll comprising a carrier web 31*c* is mounted on a shaft 31*b*, which is rotatably driven by an unwind drive mechanism 31*a*, so that the carrier web 31*c* advances toward and onto a vacuum conveyor 50. A laser cutter 52, or other suitable cutting device is disposed at a selected location on the vacuum conveyor 50, so that as the carrier web 31*c* passes through the laser cutter station, labels of a desired size are cut by the cutter 52. It is noted that the carrier web 31*c* may be pre-printed on its lower side (underneath side) with information to appear on the finished labels, or the labels may be custom printed by a printing station as the carrier web 31*c* advances toward the label application zone 38.

After cutting of the labels by the cutter 52, a glue applicator 54 applies adhesive, typically a hot melt glue or other suitable adhesive, to the upper side of each label, as it lies on the vacuum conveyor 50.

The vacuum conveyor 50 comprises a vacuum surface including vacuum apertures, constructed in a similar way as the vacuum surface discussed above in connection with prior embodiments. Thus, vacuum pressure is drawn through the vacuum apertures to hold the label 31*d* in place on the vacuum surface, with the printed side of the label down and the glued side up. The vacuum conveyor 50 is driven by a stepper or servo motor 37 so that the conveyor can be moved and stopped as desired.

Figure 10:
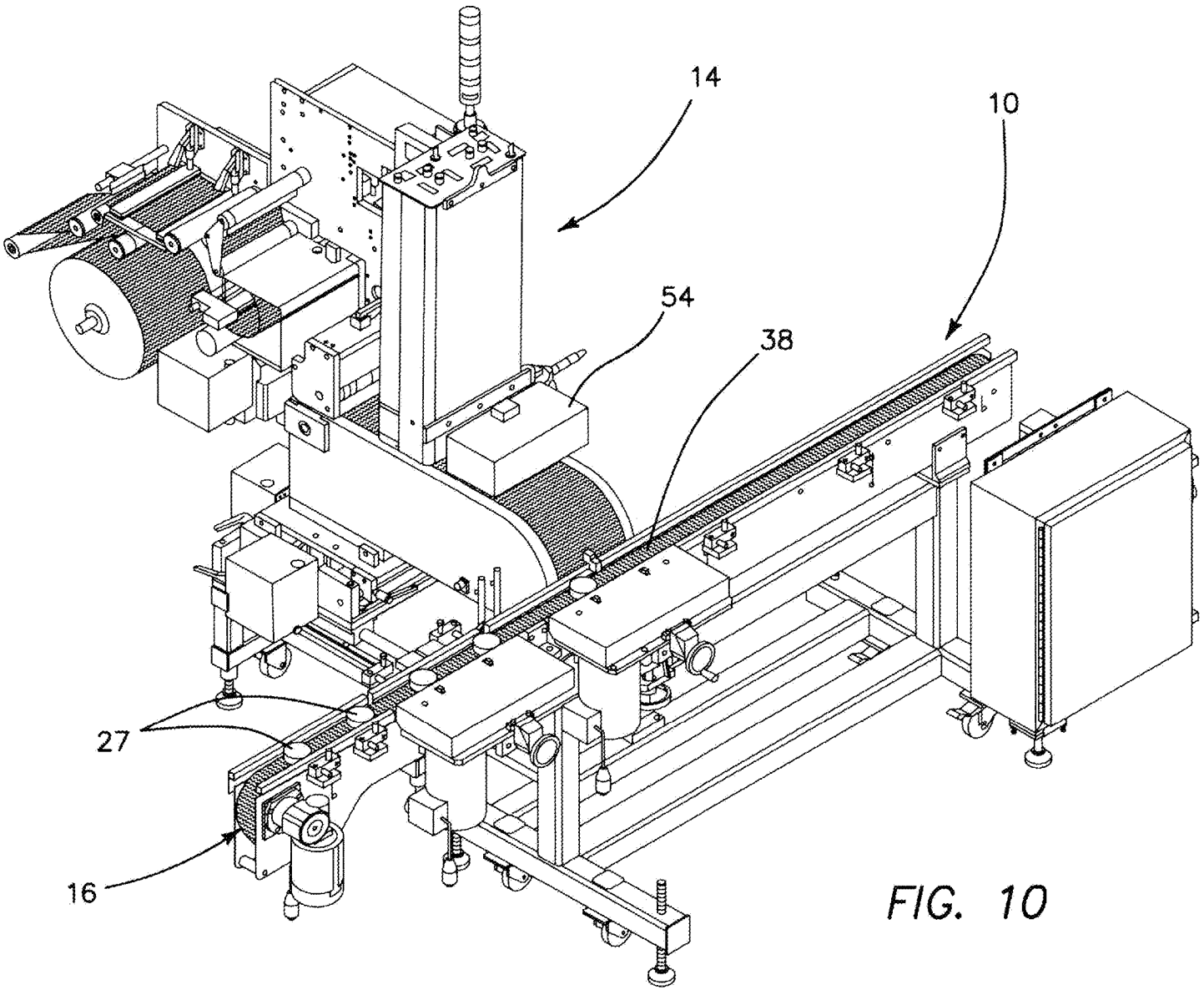
FIG. 10 is an isometric view of a labeling system utilizing the labeling applicator of FIGS. 8 and 9.
Figure 11:
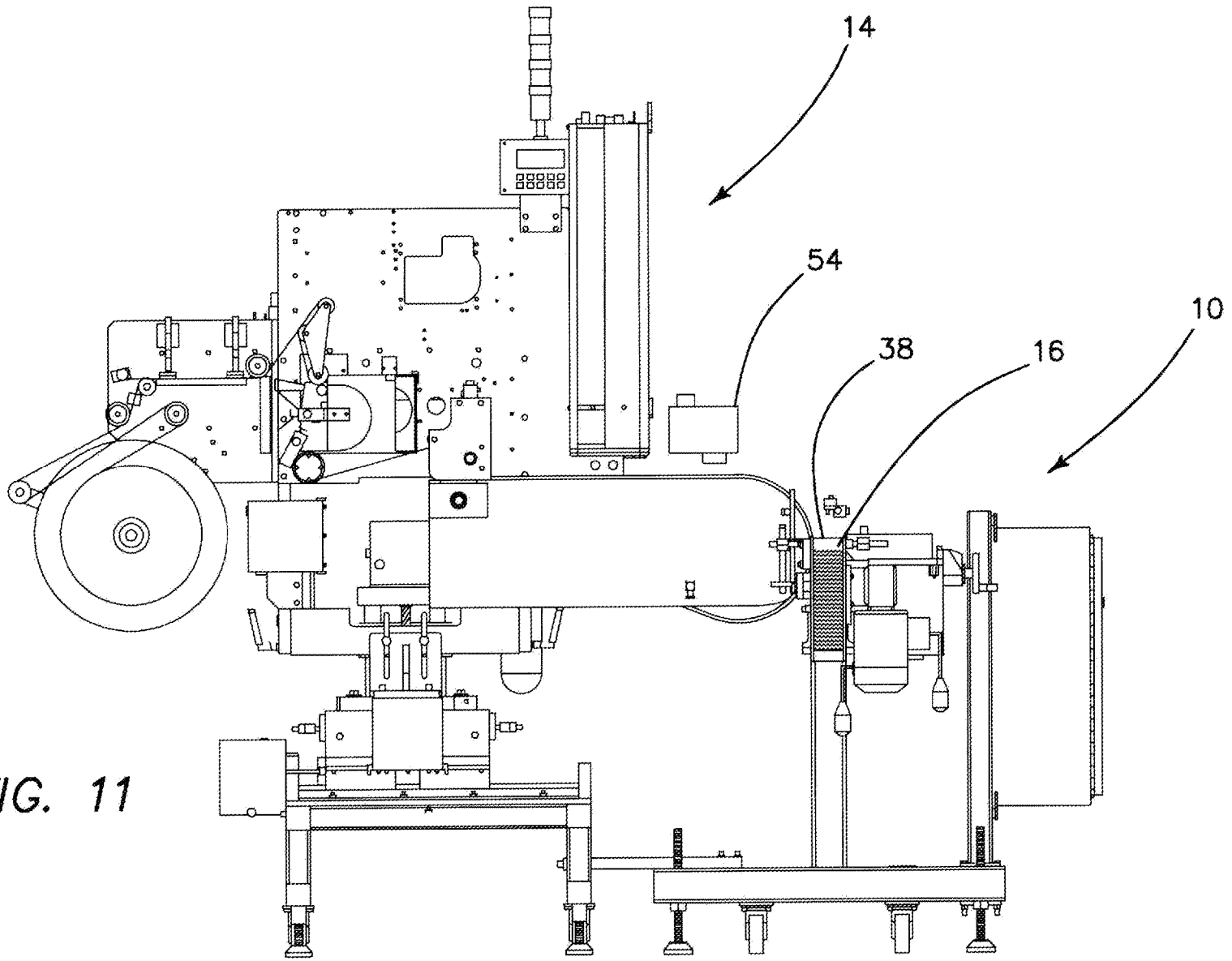
FIG. 11 is a front view of the labeling system of FIG. 10.
Figure 12:
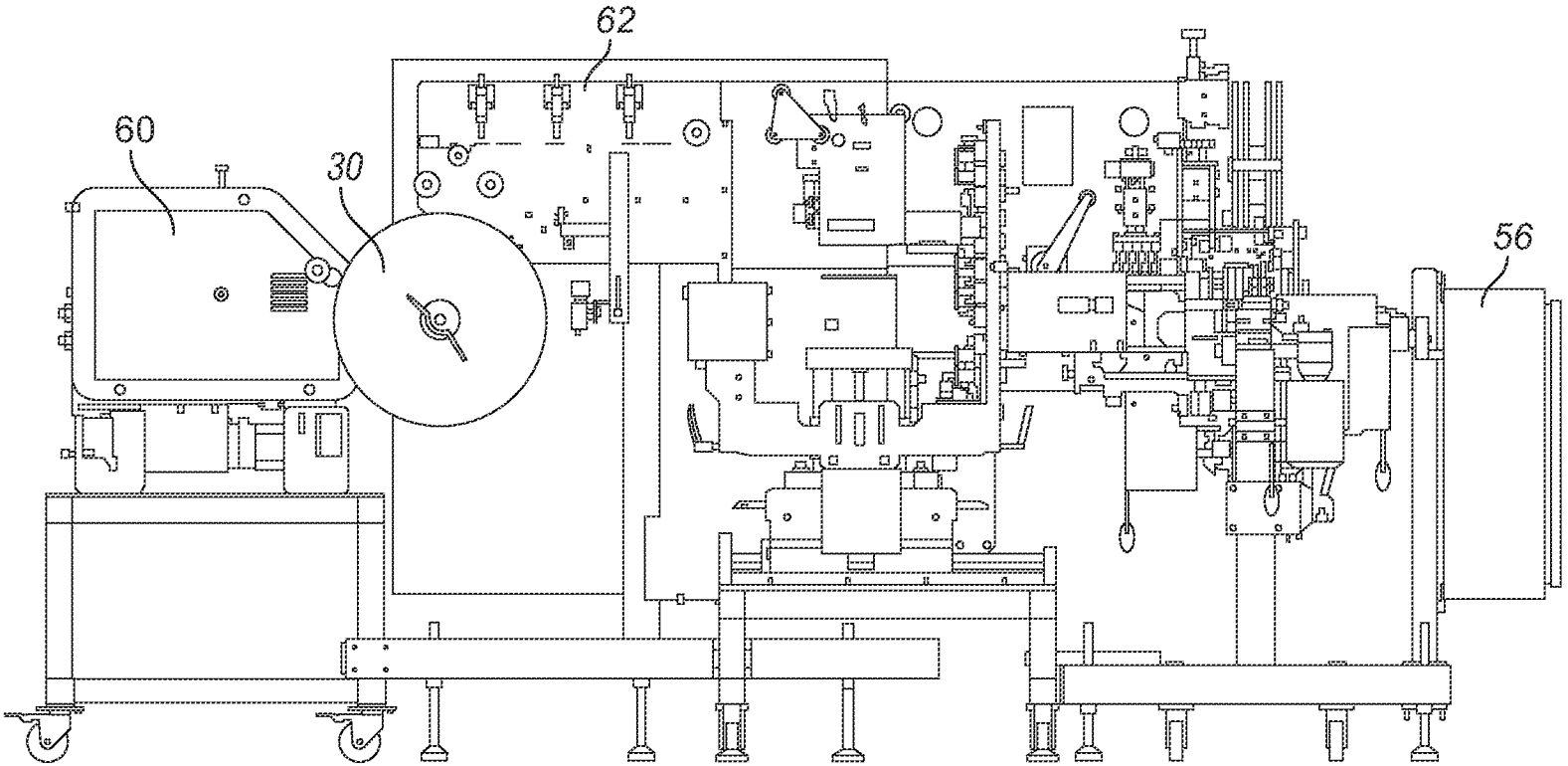
FIG. 12 is a front view of another exemplary embodiment of the labeling applicator of the present invention, which is also adapted for use with paper/glue labels.
Figure 13:
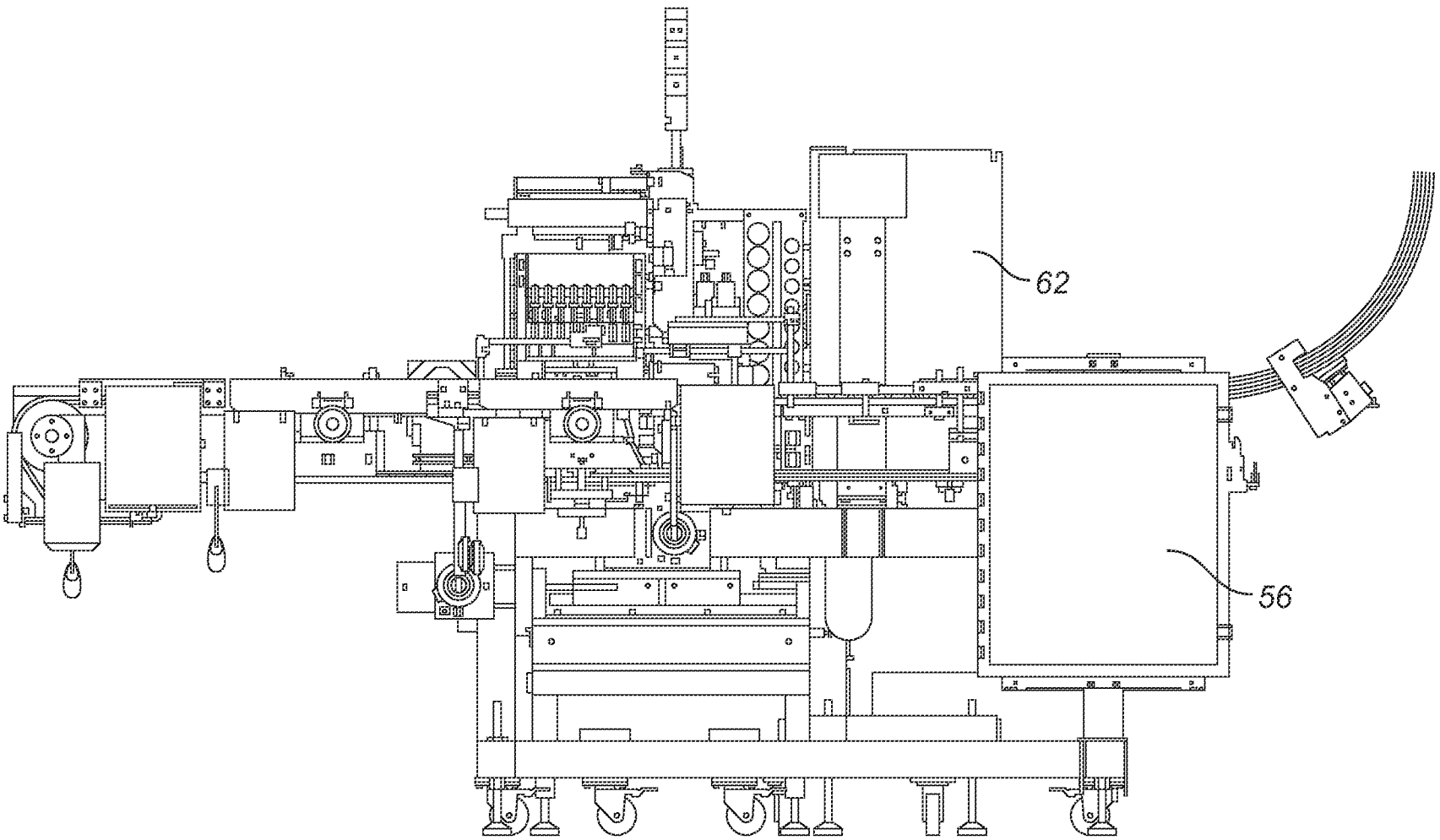
FIG. 13 is a side view of the embodiment shown in FIG. 12.
Figure 14:
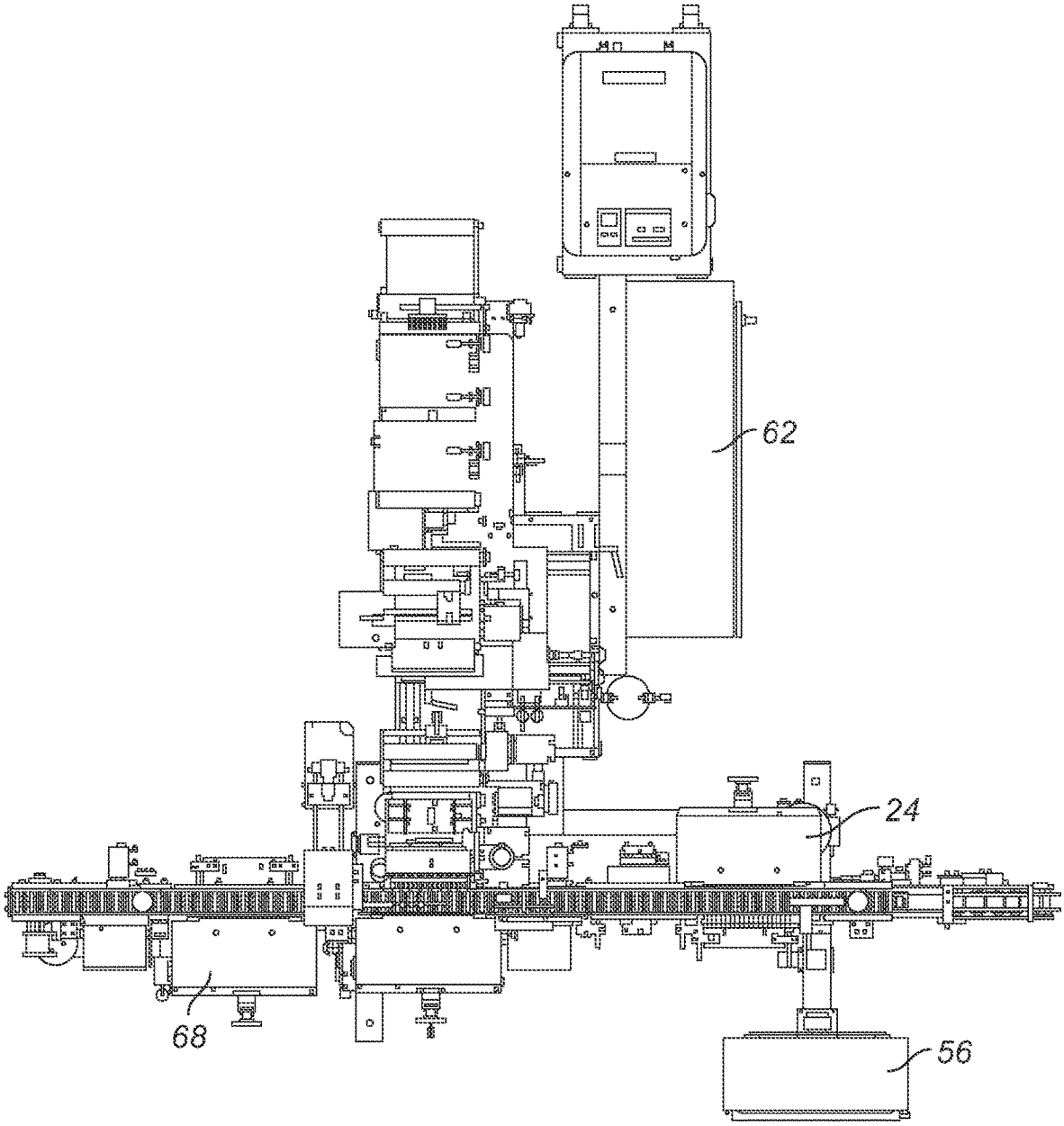
FIG. 14 is a top view of the embodiment shown in FIGS. 12 and 13.

FIGS. 10 and 11 illustrate the label applicator assembly 14 shown in FIGS. 8 and 9 in a label application system 10, which includes a conveyor assembly 16 for carrying articles 27 to be labeled through the label application zone 38. Once the labels 31*d* have been cut and glued, as described above, the labeling process is similar to that described above. In particular, as each label 31*d* enters the label application zone, the stepper or servo motor stops the vacuum conveyor so that the vacuum surface holding the label within the label application zone is stationary during the labeling process. The leading edge of the label adheres to the article as it enters the label application zone on the article conveyor 16. Since the article is rotating as it passes through the label application zone, the stationary label is applied to the article surface because of the rotation of the article. Once the label has been applied, the vacuum conveyor is restarted to move the next label into the label application zone as the next article to be labeled approaches the label application zone on the article conveyor. The vacuum conveyor is then stopped again, so that the vacuum surface holding the label is stationary during the application of the next label to the next article. This process is repeated rapidly (at a rate up to or exceeding 800 articles per minute). As is clear from the drawings, in this embodiment, as well, the labels are fed to the label application zone in a short feed orientation, meaning that the vacuum conveyor 50 feeds the labels into the label application zone in a direction generally orthogonal to the direction along which the articles to be labeled enter the label application zone on the article conveyor. Simply put, the vacuum conveyor and the article conveyor have travel directions generally orthogonal or transverse to one another. The cut labels are oriented so that the long direction of each label lies along a width of the vacuum conveyor. Therefore, each label may be quickly applied to the passing article, permitting labeling speeds exceeding 800 articles per minute.

Another exemplary modified paper-glue embodiment of the inventive system is illustrated in FIGS. 12-20. In this embodiment like elements to those in the previously described embodiments are identified with like reference numerals. Thus, in this embodiment, the label applicator assembly 14 is supported on a main frame 12. The label application system 10 which includes a conveyor assembly 16 for carrying articles 27 to be labeled through the label application zone or high speed wrap station 38. The system incorporates a non-contact hot melt glue application. Servo drives and a vacuum belt control the label material throughout the labeling process. A pneumatic linear cutting device is utilized to cut the labels, though other cutters may be used. Features include proven product conveyance, comprising back pressure control/product spacing and a high speed application spin station, as well as PLC (Programmable Logic Controller) control, which includes a vision inspection to ensure that the label is properly applied to the product and product ejection upon fault detection. The PLC further enables communication with external product handling/inspection systems, i.e. Dillon product jam detectors and backlog detector and Premier vision system.

The system of FIGS. 12-20 may also employ optional auto-splicing, which eliminates downtime for new roll splicing. The system has a modular design, which allows for separation of the applicator from the conveyance assembly, simply by removing bracing and utilizing provided casters. It can be switched from a paper-glue machine to a Pressure-Sensitive (P-S) application by simply mounting the vacuum pad assembly of a P-S applicator to the conveyance assembly, and connecting required pneumatic hoses.

Now with particular reference to the drawing FIGS. 12-20, the system includes an assembly unwind and splice table 28, with an unwind disk 30, a conveyor HMI (Human-Machine-Interface) control panel 26, a conveyor control box 56, an assembly bin box 58, a paper glue applicator 54, comprising a glue tank control 60 and a paper glue control box 62, a label inspection camera 64, a label wrapped inspection camera 66, and eject bins 68.

Figure 16:
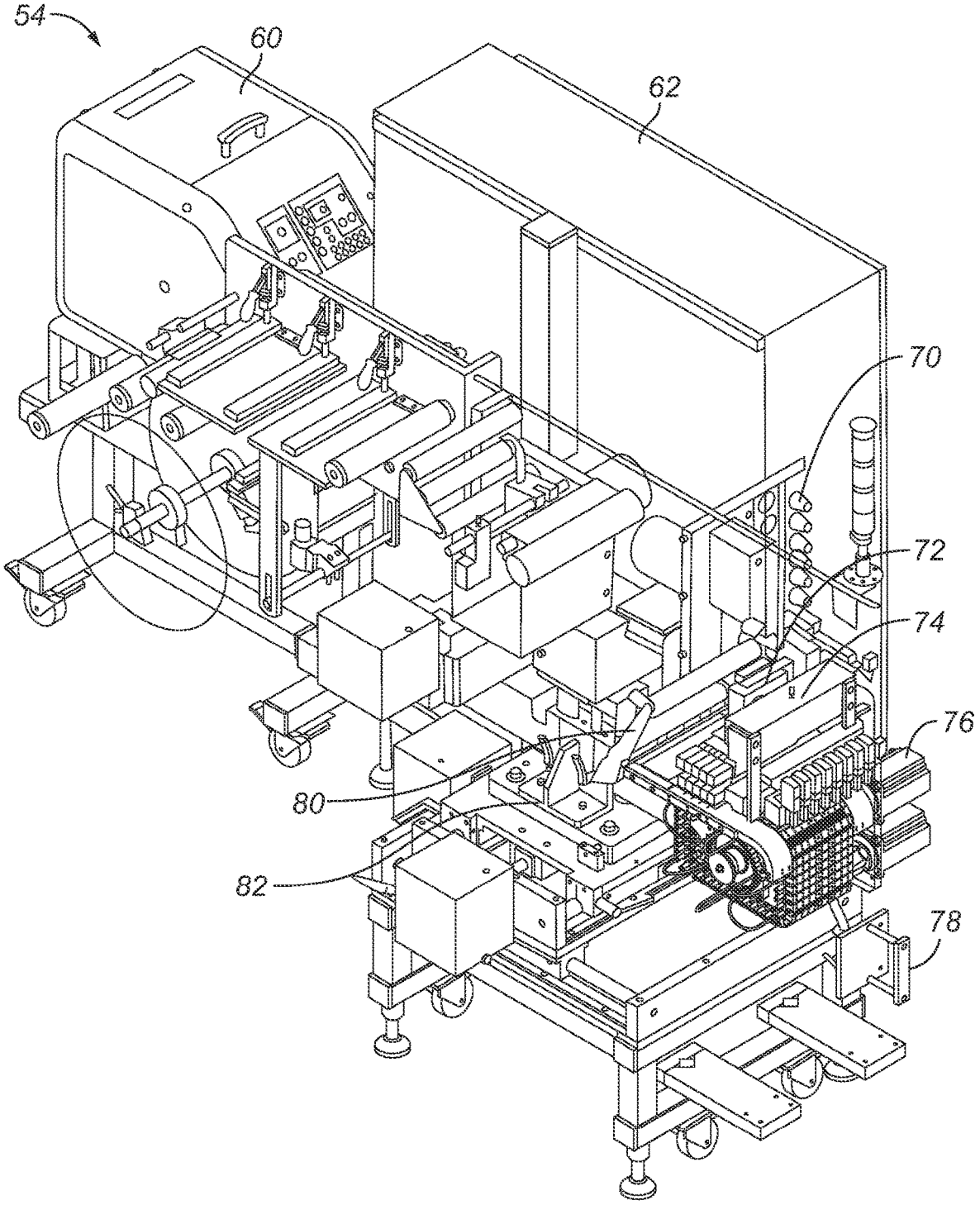
FIG. 16 is an isometric view of the embodiment shown in FIGS. 12-15 with the conveyor portion removed.

FIG. 16 illustrates, in detail, the assembly paper glue applicator 54, which comprises, in addition to the glue tank control 60 and the paper glue control box 62, assembly pneumatics regulators 70, an assembly cutting blade 72, an assembly glue nozzle 74, an assembly belt-manifold drive 76, an assembly bracing conveyor 78, an assembly nip drive 80, and an assembly mounting applicator 82. The non-contact, pneumatic high-speed, hot melt glue head applicator is custom made to the width of the desired label. First-in, first-out, non-circulating systems are preferred because of greater efficiency. Heat loss is prevented, thus requiring less energy, and the adhesive is not exposed to ambient air.

The adhesive is applied without contact to the adhesive-side of the label. This results in a uniform pattern delivery and stronger repeatable bonds. There is exceptional control of side, leading, and trailing edges, and a high-speed capability.

Hot melt applicators increase production capabilities and flexibility in high-speed continuous or intermittent processes. Low-volume, high-velocity heated air fiberizes adhesive when dispensed for precise, fine, uniform adhesive particles and patterns. There is superior cutoff and reduction of overspray for unmatched edge control, improved quality, and reduced contamination and waste. The air delivery method reduces web disruption and provides uniform adhesive coverage on porous or irregular substrates.

The glue head manifold is of the quick-change, modular type for ease of cleaning.

Figure 15:
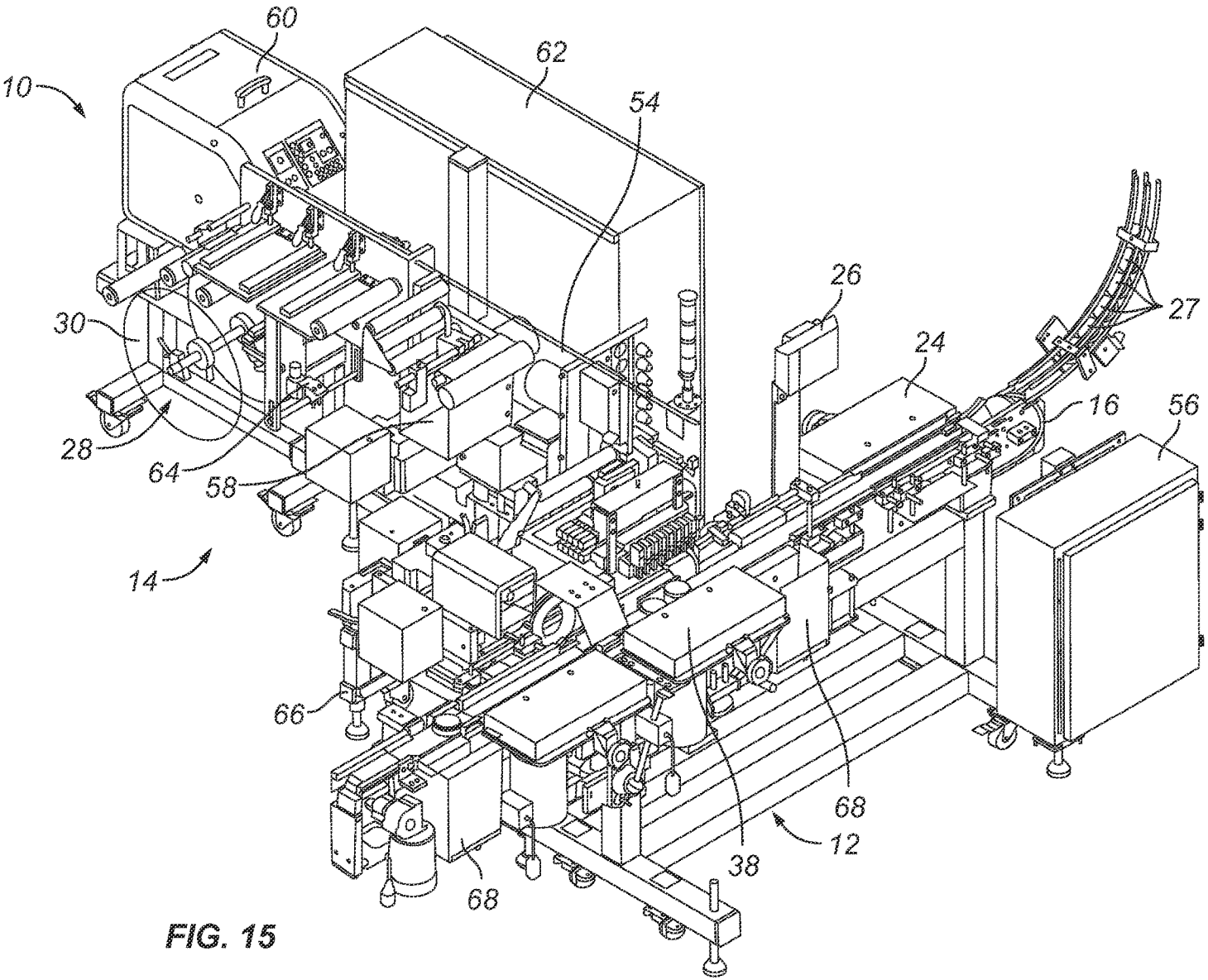
FIG. 15 is an isometric view of the embodiment shown in FIGS. 12-14, including a conveyor portion for transporting articles to be labeled.
Figure 17:
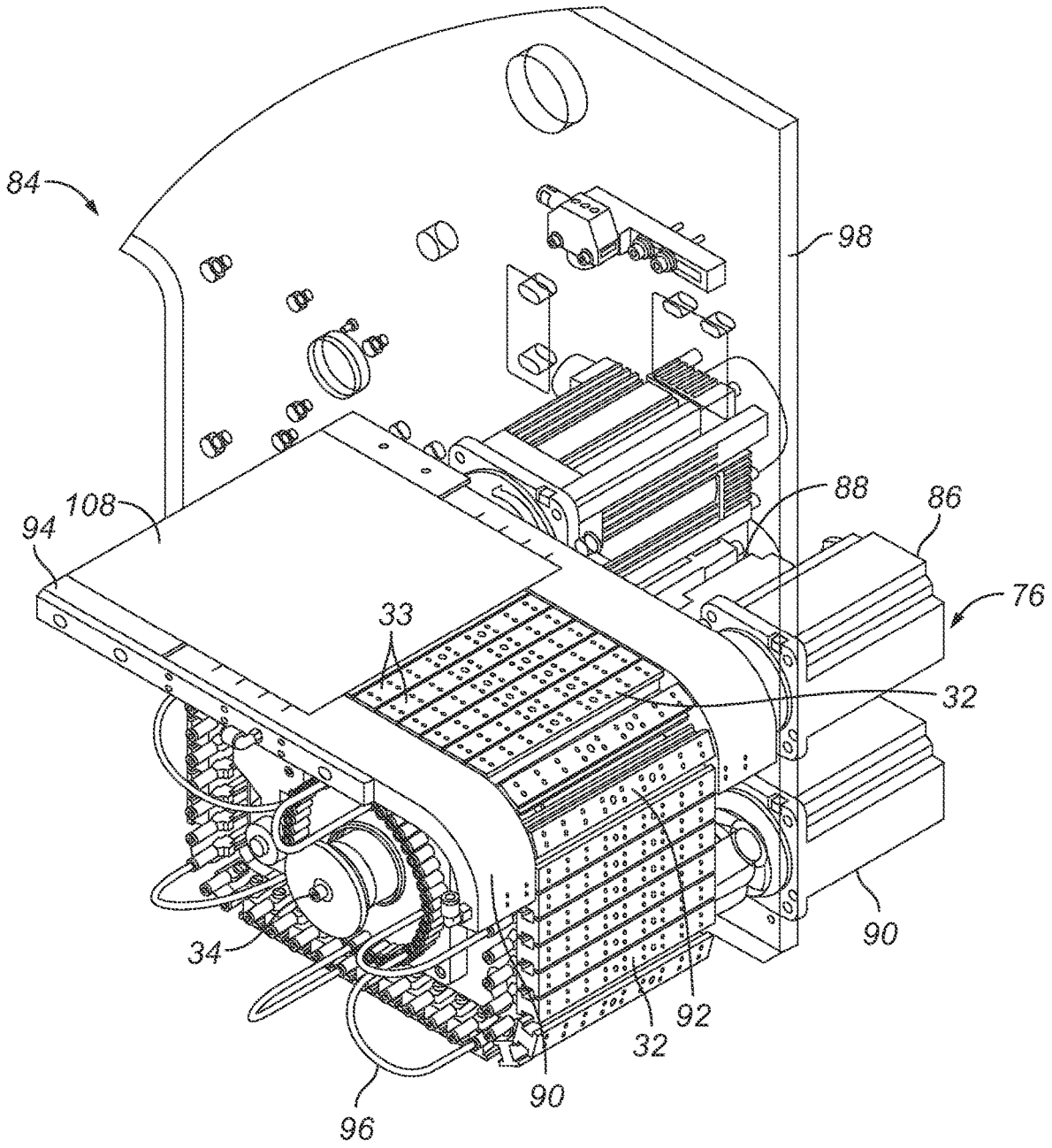
FIG. 17 is an isometric view showing an exemplary assembly driven belt manifold label carrier of the embodiment shown in FIGS. 12-16.

FIG. 17 illustrates, in detail, the assembly driven belt-manifold label carrier 84, which is illustrated, as well, in FIGS. 15 and 16. The assembly driven belt-manifold label carrier 84 comprises the assembly belt-manifold drive 76, having a belt drive system 86 comprising, in the exemplary embodiment, four (4) servo motors, a center servo motor (rotary vacuum supply) 88, and a fixed manifold 90. The label carrier 84 further comprises a belt-driven manifold 92 and a transfer table 94. As in prior embodiments, a vacuum pressure is supplied to vacuum apertures 33 in the manifold 92, which comprises a plurality of label flats 32. An assembly rotary vacuum supply 34 supplies the vacuum pressure to the vacuum apertures 33, using vacuum tubing 96. The label carrier 84 is secured to the label application system 10 via a main mounting plate 98. The vacuum transport belt may be comprised of Kevlar core constructions, for long wear, non-stretch, a high shear strength tooth to reduce backlash, and a zero backlash pulley.

Figure 18:
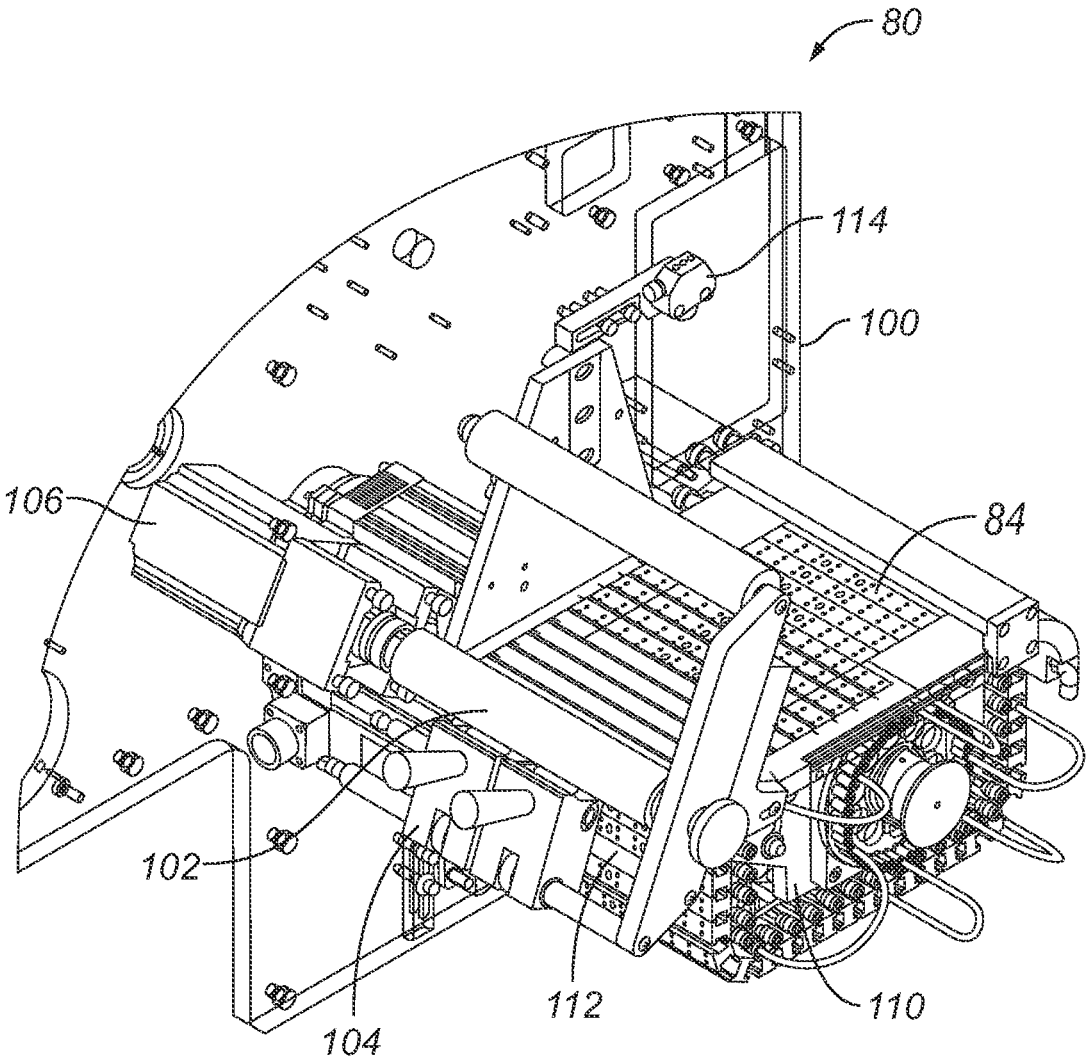
FIG. 18 is an isometric view showing an exemplary assembly nip drive of the embodiment shown in FIGS. 12-17.

In FIG. 18, the assembly nip drive 80 is illustrated in detail. A main mounting plate 100 secures the nip drive 80 to the system 10. The assembly nip drive 80 comprises an assembly drive roller 102, an assembly nip roller 104, and a servo motor drive 106 for the printed web 108. Other components include a label transfer plate 110, a support rod 112, and an assembly label sensor 114.

Figure 19:
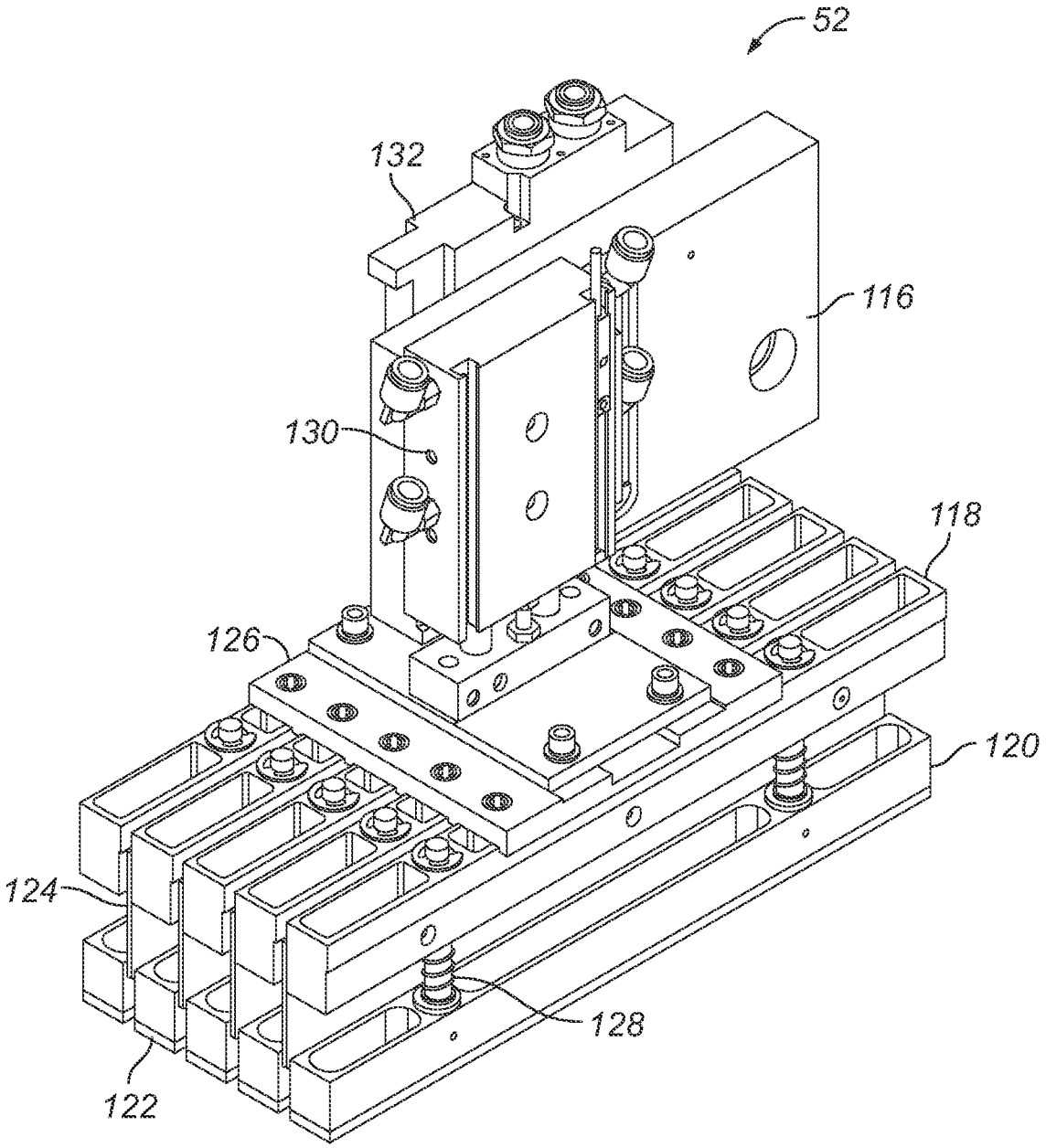
FIG. 19 is an isometric view showing an exemplary assembly label cutter of the embodiment shown in FIGS. 12-18.

FIG. 19 illustrates in detail the assembly label cutter 52. Of course, as in the prior embodiment, the label cutter 52 may comprise a laser cutter. However, the illustrated exemplary embodiment is a pneumatically controlled blade (mechanical) cutter, comprising an adjustable mounting block 116, a blade mounting block 118, a pad mounting block 120, a silicone holding pad 122, a double bevel V-shaped blade 124 (four such shallow, independent blades are used in the illustrated embodiment), all contained with a cutting blade module 126, a compression spring 128 (ten are used in the illustrated embodiment), for resiliently mounting the pad mounting block 120 to the blade mounting block 118, a high speed dual rod air cylinder 130, and a high speed valve 132. The spring loaded pad allows for control of the web during the cutting cycle. The assembly is designed for quick change removal and replacement thereof, and the blades can be individually replaced.

Figure 20:
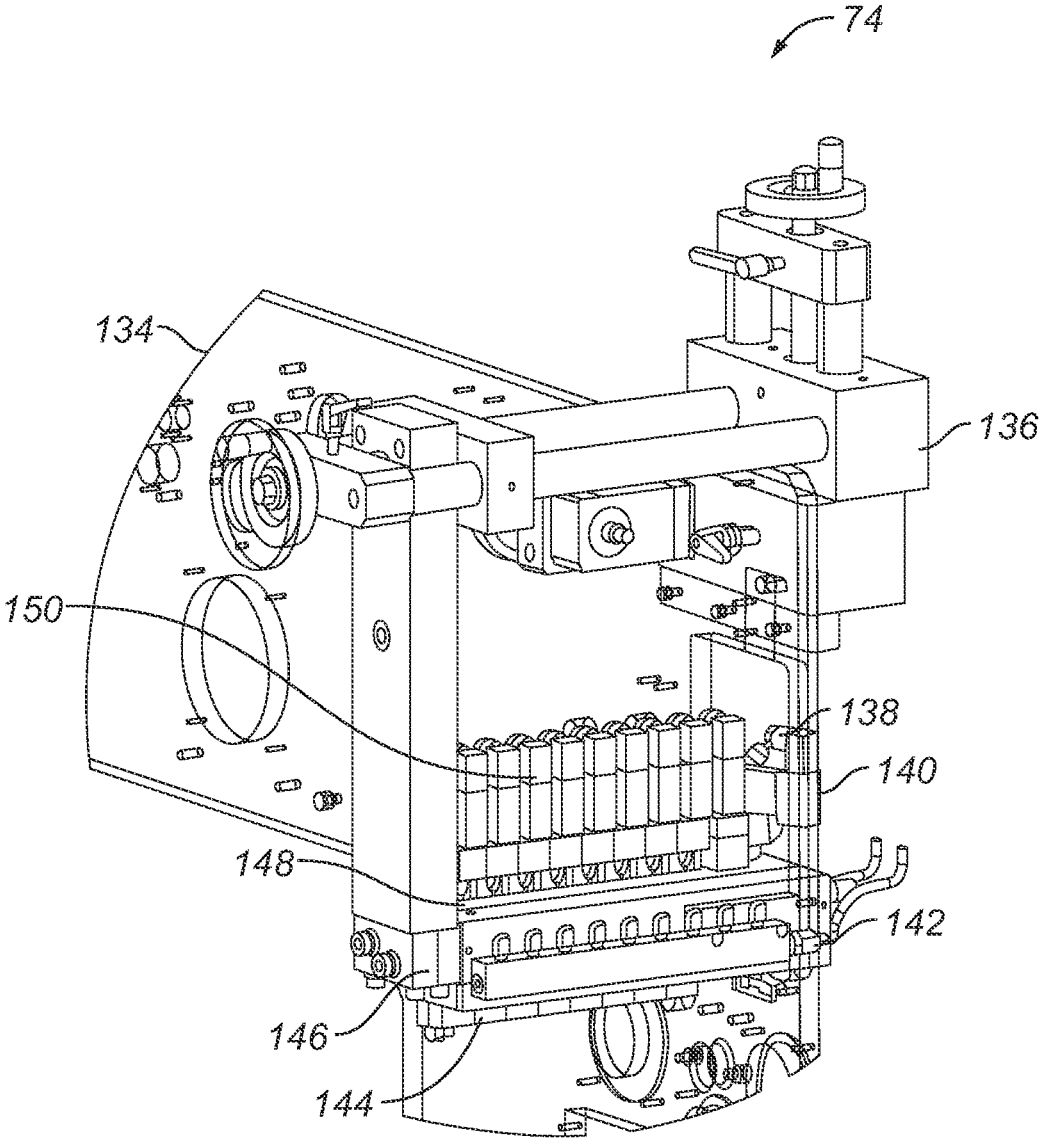
FIG. 20 is an isometric view showing an exemplary assembly glue nozzle for the embodiment shown in FIGS. 12-19.

The assembly glue nozzle 74 is illustrated in detail in FIG. 20. The assembly glue nozzle 74 comprises a main mounting plate 134, micro adjusting mounting blocks 136, a hot glue hose connector 138, an air curtain control valve 140, a hot blowing air connector 142, a special glue nozzle 144, a heat insulated connection block 146, a custom manifold 148, and a custom valve 150.

The embodiment in FIGS. 12-20 operates in a manner similar to the embodiment shown in FIGS. 8-11, and its operation will be apparent to those of skill in the art.

While this invention has been described with respect to various specific examples and embodiments, it is to be understood that various modifications may be made without departing from the scope thereof. Therefore, the above description should not be construed as limiting the invention, but merely as an exemplification of preferred embodiments thereof.

What is claimed is:

1. A label application system which applies labels to articles, comprising:

a label applicator assembly comprising a conveyor assembly which includes a vacuum conveyor on which a vacuum surface is disposed, the conveyor configured to apply vacuum pressure at the vacuum surface as the surface moves in linear and non-linear directions;

an unwind assembly comprising a shaft which is rotatably driven to rotate the shaft, the shaft being adapted to hold a roll having a carrier web thereon and the carrier web feeding onto the vacuum conveyor;

a label cutter disposed at a selected location on the vacuum conveyor, the label cutter being adapted to cut the carrier web into discrete labels of a desired size;

a glue applicator disposed at a second selected location on the vacuum conveyor, downstream of the label cutter, the glue applicator being adapted to apply glue to labels passing by the glue applicator after being cut by the label cutter, the vacuum conveyor vacuum surface moving in a linear direction between the label cutter and the glue applicator;

an article conveyor assembly which transports articles to be labeled past the label applicator assembly, the article conveyor assembly comprising a label application zone adjacent to the label applicator assembly; and a motor for moving the vacuum conveyor so that the vacuum surface moves in said linear direction downstream past the label cutter and the glue applicator and then moves in a non-linear direction to pass through the label application zone, the motor being controlled to stop the vacuum conveyor so that the vacuum surface is stationary during the application of a label to an article passing through the label application zone on the article conveyor assembly, and the motor being further controlled to restart the vacuum conveyor to move a next label into the label application zone as a next article to be labeled approaches the label application zone on the article conveyor.

2. The label application system as recited in claim 1, wherein the label cutter comprises one of a blade cutter and a laser cutter.

3. The label application system as recited in claim 1, and further comprising a printer disposed on the vacuum conveyor, wherein the labels cut by the label cutter are printed on lower sides thereof with desired information by the printer.

4. The label application system as recited in claim 1, wherein the glue applied by the glue applicator is applied to an upper side of each label passing thereby.

5. The label application system as recited in claim 1, wherein the glue comprises a hot melt adhesive.

6. The label application system as recited in claim 1, wherein the vacuum surface comprises a plurality of vacuum apertures for drawing of vacuum pressure therethrough, to hold the carrier web and cut labels on the vacuum surface.

7. The label application system as recited in claim 1, wherein the articles passing through the label application zone on the article conveyor are driven to rotate by the article conveyor assembly, so that rotation of the articles assists in applying a label to a surface of the articles.

8. The label application system as recited in claim 1, wherein the vacuum conveyor and the article conveyor are oriented so that the vacuum conveyor feeds labels into the label application zone in a direction transverse to a direction along which articles are conveyed through the label application zone by the article conveyor.

9. The label application system as recited in claim 8, wherein each label, after being cut, has a longer dimension and a shorter dimension, and lies on the vacuum conveyor with its longer dimension lying along a width of the vacuum conveyor.

10. A label application system which applies labels to articles, comprising:

a label applicator assembly comprising a conveyor assembly which includes a vacuum conveyor on which a vacuum surface is disposed, the vacuum surface extending along all or most of an entire length of the vacuum conveyor, the conveyor configured to apply vacuum pressure at the vacuum surface as the surface moves in linear and non-linear directions;

an unwind assembly comprising a shaft which is rotatably driven to rotate the shaft, the shaft being adapted to hold a roll having a carrier web thereon and the carrier web feeding onto the vacuum conveyor;

a label cutter disposed at a selected location on the vacuum conveyor, the label cutter being adapted to cut the carrier web into discrete labels of a desired size;

a glue applicator disposed at a second selected location on the vacuum conveyor, downstream of the label cutter, the glue applicator being adapted to apply glue to labels passing by the glue applicator after being cut by the label cutter, the vacuum conveyor vacuum surface moving in a linear direction between the label cutter and the glue applicator;

an article conveyor assembly which transports articles to be labeled past the label applicator assembly, the article conveyor assembly comprising a label application zone adjacent to the label applicator assembly;

the vacuum conveyor and the article conveyor being oriented so that the vacuum conveyor moves non-linearly downstream of the glue applicator to feed labels into the label application zone in a direction transverse to a direction along which articles are conveyed through the label application zone by the article conveyor;

wherein each label, after being cut, has a longer dimension and a shorter dimension, and lies on the vacuum conveyor with its longer dimension lying along a width of the vacuum conveyor.

11. The label application system as recited in claim 10, wherein the label cutter comprises one of a blade cutter and a laser cutter.

12. The label application system as recited in claim 11, wherein the labels cut by the label cutter are printed on lower sides thereof with desired information by a printing station disposed on the vacuum conveyor.

13. The label application system as recited in claim 10, wherein the glue applied by the glue applicator is applied to an upper side of labels passing thereby.

14. The label application system as recited in claim 13, wherein the glue comprises a hot melt adhesive.

15. The label application system as recited in claim 10, wherein the vacuum surface comprises a plurality of vacuum apertures for drawing of vacuum pressure therethrough, to hold the carrier web and cut labels on the vacuum surface.

16. The label application system as recited in claim 10, wherein the articles passing through the label application zone on the article conveyor are driven to rotate by the article conveyor assembly, so that rotation of the articles assists in applying the label to a surface of the articles.

17. A method for applying labels to articles, comprising:

feeding a carrier web comprising a length of paper onto a vacuum conveyor comprising a flat surface having vacuum apertures disposed therein, the vacuum apertures extending along all or most of a length of the vacuum conveyor and the vacuum conveyor configured to apply vacuum pressure at the surface as the conveyor moves the surface in linear and non-linear directions;

drawing a vacuum pressure through the vacuum apertures to hold a lower side of the carrier web on the vacuum conveyor surface;

moving the vacuum conveyor so that the carrier web passes a label cutter;

using the label cutter to cut the carrier web into labels of a desired size, having a length and a width;

moving the vacuum conveyor in a linear direction so that the cut labels pass a glue applicator;

using the glue applicator to apply glue to an upper side of each cut label passing the glue applicator;

moving an article conveyor so that articles disposed on the article conveyor pass through a label application zone;

feeding the cut labels into the label application zone on the vacuum conveyor so that the length of each label lies along a width of the vacuum conveyor, the feeding step including moving the vacuum conveyor in a non-linear direction between the glue applicator and the label application zone; and stopping the vacuum conveyor so that a label thereon is held in a stationary position as it is applied to a passing article on the article conveyor.

18. The method as recited in claim 17, and further comprising a step of re-starting the vacuum conveyor after the label has been applied to the passing article and thereby moving a next label on the vacuum conveyor into the label application zone for application to a next passing article on the article conveyor.

* * * * *